US011067933B2

(12) United States Patent
Sakaguchi

(10) Patent No.: US 11,067,933 B2
(45) Date of Patent: Jul. 20, 2021

(54) IMAGE FORMING APPARATUS PROVIDING CARTRIDGE REPLACEMENT NOTIFICATION

(71) Applicant: BROTHER KOGYO KABUSHIKI KAISHA, Nagoya (JP)

(72) Inventor: Shintaro Sakaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/550,791

(22) Filed: Aug. 26, 2019

(65) Prior Publication Data

US 2020/0073306 A1 Mar. 5, 2020

(30) Foreign Application Priority Data

Aug. 31, 2018 (JP) ..... JP2018-163936

(51) Int. Cl.
*G03G 15/00* (2006.01)
*G03G 15/08* (2006.01)
*G03G 21/18* (2006.01)

(52) U.S. Cl.
CPC ..... *G03G 15/553* (2013.01); *G03G 15/0863* (2013.01); *G03G 15/5016* (2013.01);
(Continued)

(58) Field of Classification Search
CPC ..... G03G 15/0863; G03G 15/5016; G03G 15/553; G03G 15/556; G03G 21/1817;
(Continued)

(56) References Cited

U.S. PATENT DOCUMENTS

2006/0045546 A1* 3/2006 Okochi ..... G03G 15/0863 399/13
2008/0240745 A1 10/2008 Hibino
(Continued)

FOREIGN PATENT DOCUMENTS

CN 105549361 A 5/2016
CN 205750283 U 11/2016
(Continued)

OTHER PUBLICATIONS

International Search Report and Written Opinion issued in related International Patent Application No. PCT/JP2019/033464, dated Nov. 26, 2019.

*Primary Examiner* — Robert B Beatty
(74) *Attorney, Agent, or Firm* — Merchant & Gould P.C.

(57) ABSTRACT

The image forming apparatus includes a user interface, a controller, and a main memory. The controller provides an error notification to the user interface in a case where drum cartridge information read from the main memory does not match drum-cartridge identification information stored in a drum-cartridge memory of a drum cartridge and replacement of the drum cartridge replacement is not necessary. The controller may also provide an error notification to the user interface in a case where a toner cartridge information read from the main memory does not match toner-cartridge identification information stored in a toner-cartridge memory of a toner cartridge and replacement of the toner cartridge is not necessary.

31 Claims, 14 Drawing Sheets

(52) U.S. Cl.
CPC . *G03G 21/1875* (2013.01); *G03G 2215/0695* (2013.01); *G03G 2221/1663* (2013.01)

(58) Field of Classification Search
CPC ..... G03G 21/1821; G03G 21/1875; G03G 21/1878; G03G 2215/0695; G03G 2215/0697; G03G 2221/1663; G03G 2221/1823; G03G 2221/1853
USPC ..... 399/12, 25, 27, 31, 43, 61, 81, 111, 113, 399/119
See application file for complete search history.

(56) References Cited

U.S. PATENT DOCUMENTS

| | | | | |
|---|---|---|---|---|
| 2012/0099877 | A1* | 4/2012 | Funatsu | G03G 15/55 399/26 |
| 2015/0104200 | A1* | 4/2015 | Matsumoto | G03G 15/556 399/12 |
| 2017/0219995 | A1* | 8/2017 | Sato | G03G 21/1853 |
| 2018/0299816 | A1* | 10/2018 | Sakaguchi | G03G 21/1633 |
| 2018/0314185 | A1 | 11/2018 | Yin et al. | |

FOREIGN PATENT DOCUMENTS

| | | | | | |
|---|---|---|---|---|---|
| JP | 2006071905 | A | * | 3/2006 | G03G 15/0863 |
| JP | 2008-250087 | A | | 10/2008 | |
| JP | 2008250087 | A | * | 10/2008 | G03G 15/553 |
| JP | 2014178515 | A | * | 9/2014 | |
| JP | 2015072313 | A | * | 4/2015 | |
| JP | 2015-143760 | A | | 8/2015 | |

* cited by examiner

IMAGE FORMING APPARATUS PROVIDING CARTRIDGE REPLACEMENT NOTIFICATION

CROSS-REFERENCE TO RELATED APPLICATION

This application claims priority from Japanese Patent Application No. 2018-163936 filed on Aug. 31, 2018, the content of which is incorporated herein by reference in its entirety.

TECHNICAL FIELD

Aspects described herein relate to an image forming apparatus.

BACKGROUND

A known electrophotographic image forming apparatus such as an LED printer includes a main body and a process cartridge being detachably attachable to the main body.

The process cartridge includes a drum cartridge and a toner cartridge. Both the drum cartridge and the toner cartridge are consumables that need replacement when the toner cartridge and the drum cartridge reach the end of their lives. The known image forming apparatus further includes a controller for executing a replacement time determination process and a notification device. In the replacement time determination process, the controller is configured to determine whether the drum cartridge has reached the end of its life. If in the replacement time determination process, the controller determines that the drum cartridge has reached the end of its life, the notification device provides a message indicating, for example, that the drum cartridge has reached the end of its life. Such notification may thus enable a user to recognize that the drum cartridge needs replacement.

SUMMARY

In the replacement time determination process, the controller may also determine whether the toner cartridge has reached the end of its life. If in the replacement time determination process, the controller determines that the toner cartridge has reached the end of its life, the notification device may provide a message indicating, for example, that the toner cartridge has reached the end of its life. Such notification may thus enable the user to also recognize that the toner cartridge needs replacement. That is, the user may recognize each of the replacement time of the drum cartridge and the replacement time of the toner cartridge.

Nevertheless, in such the image forming apparatus, although the replacement time determination process, the controller determines that only one of the drum cartridge and the toner cartridge has reached the end of its life, the user may replace both of the drum cartridge and the toner cartridge with respective replacement cartridges. That is, the user may replace the other cartridge that does not need replacement with a replacement cartridge by mistake.

Accordingly, some embodiments of the disclosure provide for a technique for prompting a user to determine again whether the current cartridge replacement is appropriate if a cartridge that might not need replacement has been replaced with a replacement cartridge.

A first aspect of the disclosure provides an image forming apparatus with structure described below. The image forming apparatus includes a frame, a drum cartridge, a toner cartridge, at least one of a display and a speaker, a controller, and a main-body memory. The drum cartridge is detachably attachable to the frame. The drum cartridge includes a photosensitive drum and a drum-cartridge memory. The drum-cartridge memory is stored in a first drum-cartridge identification information. The toner cartridge is detachably attachable to the frame. The toner cartridge includes a toner-cartridge memory. The toner-cartridge memory is stored in a toner-cartridge identification information. The controller executes a first determination process, a second determination process, a first replacement time determination process, a second replacement time determination process, a first error notification process, a second error notification process. In the first determination process, the controller determines whether a drum-cartridge identification information read from the main-body memory matches the drum-cartridge identification information stored in the drum-cartridge memory. In the second determination process, the controller determines whether a toner-cartridge identification information read from the main-body memory matches the first toner-cartridge identification information stored in the toner-cartridge memory. In the first replacement time determination process, the controller determines whether the drum cartridge replacement is necessary. In the second replacement time determination process, the controller determines whether the toner cartridge replacement is necessary. In the first error notification process, the controller provides an error notification to at least one of the display and the speaker, in a case where the drum cartridge identification information read from the main-body memory does not match the drum-cartridge identification information stored in the drum-cartridge memory in the first determination process and the drum cartridge replacement is not necessary in the first replacement time determination process. In the second error notification process, the controller provides the error notification to at least one of the display and the speaker, in a case where the toner cartridge identification information read from the main-body memory does not match the toner-cartridge identification information stored in the toner-cartridge memory in the second determination process and the toner cartridge replacement is not necessary in the second replacement time determination process.

A further aspect of the disclosure provides an image forming apparatus comprising a user interface, a controller, and a main memory accessible by the controller. The controller is configured to execute determining whether drum-cartridge identification information read from the main memory matches drum-cartridge identification information stored in a drum-cartridge memory of a drum cartridge, and determining whether toner-cartridge identification information read from the main memory matches toner-cartridge identification information stored in a toner-cartridge memory of a toner cartridge. The controller is further configured to execute determining whether replacement of the drum cartridge is necessary and determining whether replacement of the toner cartridge is necessary. The controller is also configured to execute providing a first error notification to the user interface, in a case where the drum cartridge identification information read from the main memory does not match the drum-cartridge identification information stored in the drum-cartridge memory and replacement of the drum cartridge is not necessary, and providing a second error notification to the user interface, in a case where the toner cartridge identification information read from the main memory does not match the toner-cartridge identification information stored in the toner-cartridge memory and replacement of the toner cartridge is not necessary.

A still further aspect of the disclosure provides an image forming apparatus comprising a frame, a drum cartridge being detachably attachable to the frame, the drum cartridge including a photosensitive drum and a drum-cartridge memory, and a toner cartridge being detachably attachable to the frame, the toner cartridge including a toner-cartridge memory. The image forming apparatus also includes a user interface, a controller, and a main memory accessible by the controller. The controller is configured to execute determining whether drum-cartridge identification information read from the main memory matches drum-cartridge identification information stored in the drum-cartridge memory, and determining whether toner-cartridge identification information read from the main memory matches toner-cartridge identification information stored in the toner-cartridge memory. The controller is further configured to execute determining whether replacement of the drum cartridge is necessary, and determining whether replacement of the toner cartridge is necessary. The controller is also configured to execute providing a first error notification to the user interface, in a case where the drum cartridge identification information read from the main memory does not match the drum-cartridge identification information stored in the drum-cartridge memory and replacement of the drum cartridge is not necessary, and providing a second error notification to the user interface, in a case where the toner cartridge identification information read from the main memory does not match the toner-cartridge identification information stored in the toner-cartridge memory and replacement of the toner cartridge is not necessary.

A still further aspect of the disclosure provides an image forming apparatus comprising a frame configured to detachably receive a drum cartridge and a toner cartridge, a user interface, a controller, and a main memory accessible by the controller. The controller is configured to execute determining whether replacement of the drum cartridge is necessary and determining whether replacement of the toner cartridge is necessary. In a case that replacement of one of the toner cartridge or the drum cartridge is not necessary, the controller is configured to provide a notification to the user interface indicating that replacement of only one of the drum cartridge or the toner cartridge is required.

A still further aspect of the disclosure provides an image forming apparatus comprising a frame configured to detachably receive a drum cartridge and a toner cartridge, a user interface, a controller, and a main memory accessible by the controller. The controller is configured to execute determining whether replacement of the drum cartridge is necessary, determining whether replacement of the toner cartridge is necessary, providing a first error notification to the user interface, in a case where the drum cartridge has been replaced and replacement of the drum cartridge is not necessary, and providing a second error notification to the user interface, in a case where the toner cartridge has been replaced and replacement of the toner cartridge is not necessary.

In a case where the drum cartridge and the toner cartridge are both attachable to and detachable from the frame, although only one of the drum cartridge and the toner cartridge has reached the end of its life and thus needs to be replaced with a replacement cartridge, the user may mistakenly replace the other cartridge that might not need replacement as well as the one cartridge. According to one or more aspects of the disclosure, if both of the drum cartridge and the toner cartridge have been replaced with respective replacement cartridges, the controller may determine, with respect to each of the drum cartridge and the toner cartridge, whether the cartridge replacement is necessary. If the controller determines that the cartridge replacement is not necessary, the controller may execute error notification. Such notification may thus enable the user to determine again whether the current cartridge replacement is appropriate.

DETAILED DESCRIPTION

Illustrative embodiments will be described with reference to the accompanying drawings.

1. First Illustrative Embodiment

1-1. Configuration of Image Forming Apparatus

Figure 1:
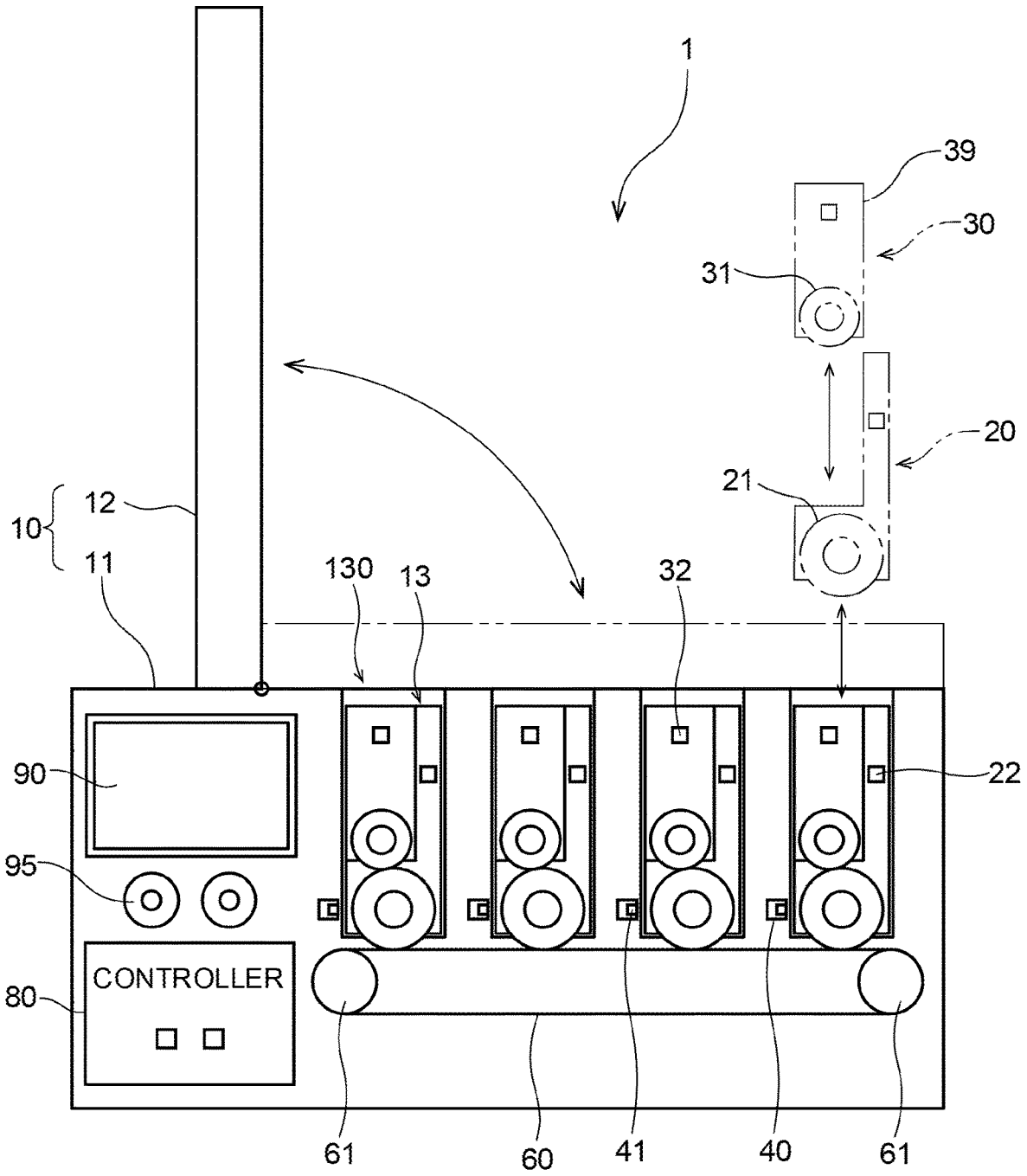
FIG. 1 is a schematic view of an image forming apparatus in illustrative embodiments according to one or more aspects of the disclosure.

An image forming apparatus 1 according to a first illustrative embodiment may be an electrophotographic printer. Examples of the image forming apparatus 1 includes LED printers. As illustrated in FIG. 1, the image forming apparatus 1 includes a casing 10, a plurality of drum cartridges 20, a plurality of toner cartridges 30, a plurality of light sources 40, a transfer belt 60, a controller 80, a display 90, and a speaker 95. For example, the image forming apparatus 1 includes four each of the drum cartridges 20, the toner cartridges 30, and the light sources 40.

The casing 10 includes a frame 11 and a cover 12. The casing 10 accommodates the drum cartridges 20, the toner cartridges 30, the light sources 40, the transfer belt 60, and the controller 80. The display 90 and the speaker 95 are disposed at an outer surface of the casing 10. The frame 11 includes a plurality of, for example, four, cartridge holders 13. Each cartridge holder 13 has an opening 130. As illustrated in FIG. 1, the cover 12 is configured to pivot between a closed position (indicated by a double-dotted-and-dashed line) and an open position (indicated by a solid line). When the cover 12 is positioned at the closed position, the openings 130 of the cartridge holders 13 are covered by the cover 12. When the cover 12 is positioned at the open position, the openings 130 of the cartridge holders 13 are exposed.

Each drum cartridge 20 is detachably attachable to a corresponding one of the cartridge holders 13 with a corresponding toner cartridge 30 being attached thereto. A toner cartridge 30 is attached to a drum cartridge 20 and used in a pair with the drum cartridge 20. Such a pair may be referred to as a process cartridge. That is, each process cartridge is detachably attachable to a corresponding one of the cartridge holders 13. In the description below, plural same components have the same or similar configuration and function in the same or similar manner to each other. Therefore, one of the plural same components will be described in detail, and a description for the others will be omitted.

The drum cartridge 20 includes a photosensitive drum 21. The photosensitive drum 21 has a cylindrical shape. The photosensitive drum 21 is configured to rotate about a drum axis. The photosensitive drum 21 has a circumferential surface covered by photosensitive material. The drum cartridge 20 further includes a drum-cartridge memory 22. The drum-cartridge memory 22 may be a readable and rewritable storage medium. The drum-cartridge memory 22 may be, for example, a flash memory or an EEPROM.

The drum-cartridge memory 22 is configured to store various information about the drum cartridge 20. More specifically, for example, the drum-cartridge memory 22 may store at least both of drum-cartridge identification information and drum-cartridge life information relating to the life of the photosensitive drum 21. The drum-cartridge identification information may be, for example, a serial number. The drum-cartridge life information may be any known information that may be used for determination as to whether the drum cartridge 20 needs replacement. The drum-cartridge life information may include, for example, at least one of the total number of rotations of the photosensitive drum 21 and the total number of sheets that have been printed using the photosensitive drum 21. In the first illustrative embodiment, the total number of rotations of the photosensitive drum 21 may be a total rotation count of the photosensitive drum 21 in the drum cartridge 20 counted since the drum cartridge 2 was first used in the image forming apparatus 1 or another. The total number of rotations of the photosensitive drum 21 may be updated by every execution of an update process by the controller 80 while the drum cartridge 20 is attached to the frame 11. The total number of sheets that have been printed using the photosensitive drum 21 may be a total count of sheets that have been printed using the photosensitive drum 21 counted since the drum cartridge 20 was first used in the image forming apparatus 1 or another. The total number of sheets that have been printed using the photosensitive drum 21 may be updated by every execution of the update process by the controller 80 while the drum cartridge 20 is attached to the frame 11. The drum-cartridge memory 22 may also store other information, for example, conforming models, specifications of the drum cartridge 20, information as to whether the drum cartridge 20 is a yet-to-be-used cartridge, and/or an error record of the drum cartridge 20.

The toner cartridge 30 is detachably attachable to the drum cartridge 20. The toner cartridge 30 includes a housing 39 for storing toner (e.g., developer). The toner cartridges 30 store toners of respective different colors (e.g., cyan, magenta, yellow, and black). The toner cartridge 30 further includes a developing roller 31. The developing roller 31 has a cylindrical shape. The developing roller 31 is configured to rotate about a developing axis. In a state where the toner cartridge 30 is attached to the drum cartridge 20, a circumferential surface of the photosensitive drum 21 contacts a circumferential surface of the developing roller 31 of the toner cartridge 30. The toner cartridge 30 further includes a toner-cartridge memory 32. The toner-cartridge memory 32 may be a readable and rewritable storage medium. The toner-cartridge memory 32 may be, for example, a flash memory or an EEPROM.

The toner-cartridge memory 32 is configured to store various information about the toner cartridge 30. More specifically, for example, the toner-cartridge memory 32 may store at least both of toner-cartridge identification information and toner-cartridge life information relating to the life of the toner cartridge 30. The toner-cartridge identification information may be, for example, a serial number. The toner-cartridge life information may be any known information that may be used for determination as to whether the toner cartridge 30 needs replacement. The toner-cartridge life information may include, for example, at least one of the total number of rotations of the developing roller 31, the total number of sheets that have been printed using the developing roller 31, or the number of output dots. In the first illustrative embodiment, the total number of rotations of the developing roller 31 may be a total rotation count of the developing roller 31 in the toner cartridge 30 counted since the toner cartridge 30 was first used in the image forming apparatus 1 or another. The total number of rotations of the developing roller 31 may be updated by every execution of the update process by the controller 80 while the toner cartridge 30 is attached to the frame 11. The total number of sheets that have been printed using the developing roller 31 may be a total count of sheets that have been printed using the developing roller 31 counted since the toner cartridge 30 was first used in the image forming apparatus 1 or another. The total number of sheets that have been printed using the developing roller 31 may be updated by every execution of the update process by the controller 80 while the toner cartridge 30 is attached to the frame 11. The toner-cartridge memory 32 may also store other information, for example, conforming models, specifications of the toner cartridge 30, information as to whether the toner cartridge 30 is a yet-to-be-used cartridge, and/or an error record of the toner cartridge 30.

While the cover 12 is positioned at the open position, the process cartridge including the drum cartridge 20 and the toner cartridge 30 may be attached to the frame 11. More specifically, the process cartridge may be attached to the cartridge holder 13 via the opening 130.

In a state where the drum cartridge 20 is attached to the frame 11, the light source 40 faces the circumferential surface of the photosensitive drum 21. The light source 40 is positioned at the frame 11 or at the cover 12. The light source 40 includes a plurality of light emitters 41. The light emitters 41 are positioned parallel to the drum axis of the photosensitive drum 21. The light emitters 40 are configured to emit light onto the circumferential surface of the photosensitive drum 21. The light emitters 41 may be, for example, LEDs.

The light source 40 is electrically connected to the controller 80. The controller 80 causes the light emitters 41 of the light source 40 to emit light in accordance with inputted image data. The light emitters 41 thus illuminate the circumferential surface of the photosensitive drum 21 with light, thereby exposing the photosensitive material covering the circumferential surface of the photosensitive drum 21 in accordance with the inputted image data. The light source 40 might not be limited to the specific example. In other embodiments, for example, the light source 40 may include a light emitter (e.g., a laser emitter), a polygon mirror, lenses, and reflectors.

The transfer belt 60 is in contact with the circumferential surfaces of the photosensitive drums 21. The transfer belt 60 may be an endless belt. The circumferential surface of each of the photosensitive drums 21 contacts an outer circumferential surface of the transfer belt 60. During printing, a sheet enters and passes between the transfer belt 60 and each of the photosensitive drums 21. A drive roller 61 is configured to rotate the transfer belt 60. The controller 80 is configured to rotate the drive roller 61. A driven roller 62 is configured to rotate following the rotation of the transfer belt 60 caused by the rotation of the drive roller 61.

Figure 2:
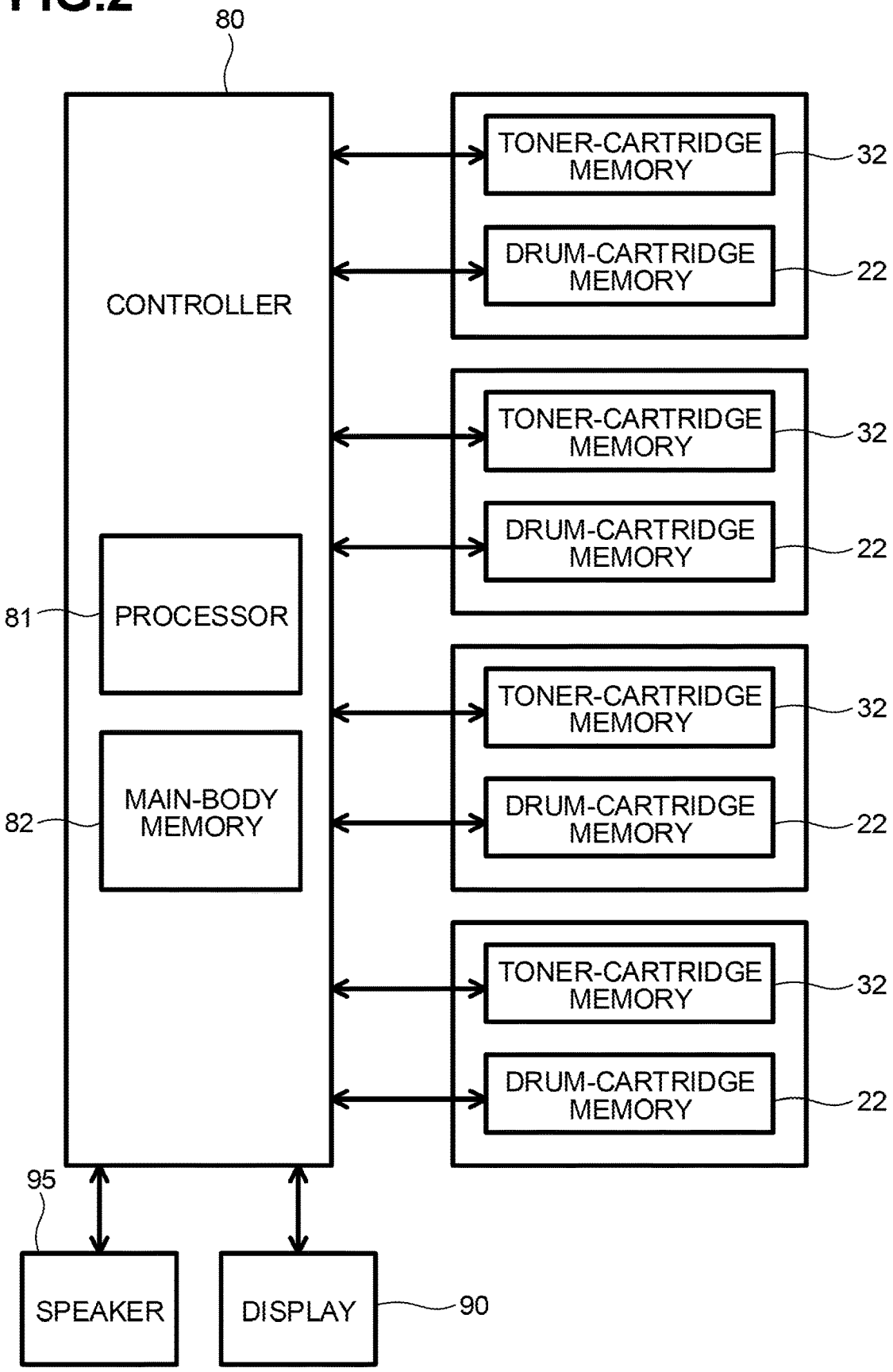
FIG. 2 is a block diagram of an electrical configuration of the image forming apparatus in the illustrative embodiments according to one or more aspects of the disclosure.

The controller 80 includes a processor 81 and accesses a main memory, such as a main-body memory 82 included in the controller 80. The main-body memory 82 may be a readable and rewritable storage medium. The main-body memory 82 may be, for example, a flash memory or an EEPROM. In the first illustrative embodiment, as illustrated in FIG. 2, the controller 80 includes the main-body memory 82. Nevertheless, in other embodiments, for example, the controller 80 might not include the main-body memory 82. That is, the main-body memory 82 may be provided outside of the controller 80.

The main-body memory 82 stores computer programs for controlling operation of the image forming apparatus 1. The main-body memory 82 is configured to store the drum-cartridge identification information, the drum-cartridge life information, the toner-cartridge identification information, and the toner-cartridge life information. In the first illustrative embodiment, the main-body memory 82 further stores a first threshold and a second threshold. The first threshold may be used in determination executed by the controller 80 as to whether the drum cartridge 20 needs replacement. The second threshold may be used in determination executed by the controller 80 as to whether the toner cartridge 30 needs replacement. The processor 81 is configured to execute various processing in accordance with an appropriate computer program stored in the main-body memory 82. The processor 81 may execute a first storing process, a second storing process, an update process, a first replacement time determination process, a second replacement time determination process, a first reading process, a second reading process, a first determination process, a second determination process, a first error notification process, and a second error notification process.

The display 90 is configured to display, for example, information relating to the operation of the image forming apparatus 1 and error (e.g., warning or other notification) information in accordance with an instruction provided by the controller 80. The display 90 is electrically connected to the controller 80. In the first illustrative embodiment, the display 90 is configured to output error information. The speaker 95 is also configured to output error information. The speaker 95 is electrically connected to the controller 80. The speaker 95 is configured to output a voice message indicating, for example, the information relating to the operation of the image forming apparatus 1 and the error (warning) information. Nevertheless, in other embodiments, for example, the image forming apparatus 9 may include only one of the display 90 or the speaker 95. The display 90 and speaker 95 are examples of a user interface of the image forming apparatus 1.

FIG. 2 illustrates connection between the controller 80, each drum-cartridge memory 22, and each toner-cartridge memory 32 in a state where the process cartridges are attached to the frame 11. FIG. 2 also illustrates connection between the controller 80, the display 90, and the speaker 95. The controller 80 may cause the plural same components to perform the same or similar operation, and therefore, one of the plural same components will be described in detail, and a description for the others will be omitted. When the process cartridge is attached to the frame 11, the drum-cartridge memory 22 of the drum cartridge 20 is electrically connected to the controller 80 via a corresponding connector for drum cartridge of the frame 11. This connection may enable the processor 81 to access the drum-cartridge memory 22 to read and write information from and into the drum-cartridge memory 22. The toner-cartridge memory 32 of the toner cartridge 30 is also electrically connected to the controller 80 via a corresponding connector for toner cartridge of the frame 11. This connection may also enable the processor 81 to access the toner-cartridge memory 32 to read and write information from and into the toner-cartridge memory 32. Nevertheless, in other embodiments, for example, the toner-cartridge memory 32 may be electrically connected to the controller 80 via the drum-cartridge memory 22 of the drum cartridge 20.

During printing, the controller 80 drives a motor to rotate. Driving of the motor causes the photosensitive drum 21 and the developing roller 31 of the process cartridge to rotate. The controller 80 further causes the light emitters 41 of the light source 40 to emit light onto the circumferential surface of the photosensitive drum 21. Light emitted by the light emitters 40 reaches the circumferential surface of the photosensitive drum 21. Thus, an electrostatic latent image to be printed is formed on the circumferential surface of the photosensitive drum 21. Toner is supplied from the toner cartridge 30 to the circumferential surface of the photosensitive drum 21 via the developing roller 31 to form a toner image on the circumferential surface of the photosensitive drum 21. Thereafter, the toner image is transferred onto a sheet conveyed between the photosensitive drum 21 and the transfer belt 60 from the circumferential surface of the photosensitive drum 21. The toner image is thus transferred onto the sheet from the circumferential surface of the photosensitive drum 21. The sheet having the toner image is then conveyed to a fixing unit in the image forming apparatus 1. The fixing unit fixes the toner image on the sheet by heat. Thus, printing of an image onto the sheet is completed.

1-2. Processes Executed by Image Forming Apparatus

Referring to FIGS. 3 to 7, processes executed by the controller 80 of the image forming apparatus 1 will be described.

1-2-1. Update Process

Figure 3:
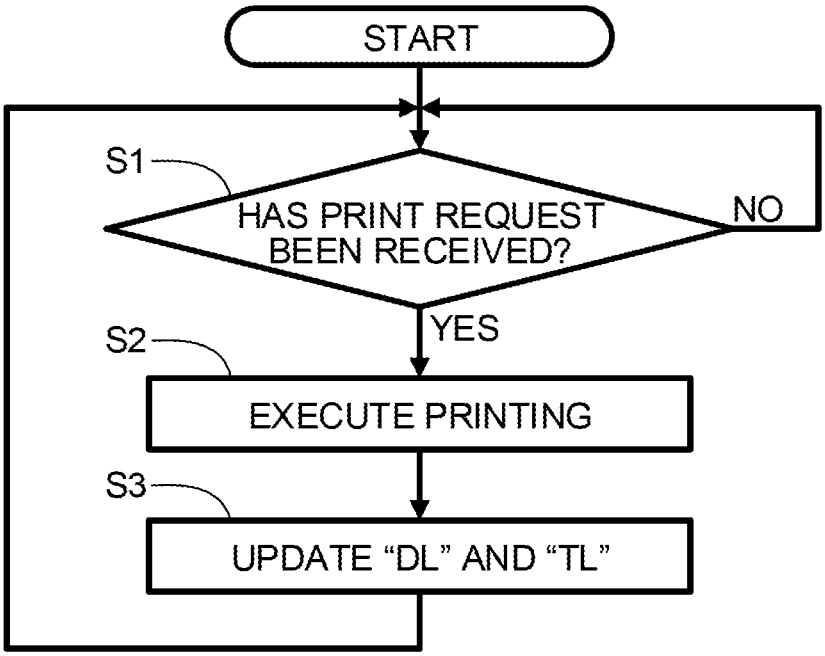
FIG. 3 is a flowchart of an update process in a first illustrative embodiment according to one or more aspects of the disclosure.

Referring to FIG. 3, processes to be executed by the controller 80 before and after printing will be described. After a printing preparation process (e.g., a warm-up process) is completed, in step S1, the controller 80 determines whether a print request has been received. More specifically, for example, the controller 80 determines whether an image to be printed has been received. If the controller 80 determines that a print request has been received (e.g., YES in step S1), the controller 80 activates the developing rollers 31, the photosensitive drums 21, the light sources 40, and the transfer belt 60. That is, the controller 80 executes printing (e.g., an image forming operation) (e.g., step S2). After executing the printing (e.g., step S2), in step S3 (e.g., an update process), the controller 80 accesses the drum-cartridge memory 22 of each of the drum cartridges 20 and the main-body memory 82. The controller 80 updates drum-cartridge life information DL stored in the drum-cartridge memory 22 of each of the drum cartridges 20 and drum-cartridge life information DL about each of the drum cartridges 20 stored in the main-body memory 82. In step S3, the controller 80 also accesses the toner-cartridge memory 32 of each of the toner cartridges 30 and the main-body memory 82. The controller 80 updates toner-cartridge life information TL stored in the toner-cartridge memory 32 of each of the toner cartridges 30 and toner-cartridge life information TL about of each of the toner cartridges 30 stored in the main-body memory 82.

If the controller 80 determines that a print request has not been received (e.g., NO in step S1), the controller 80 waits until the controller 80 determines that a print request has been received. That is, the controller 80 repeats determination as to whether an image to be printed has been received.

1-2-2. Determination Process

Figure 4:
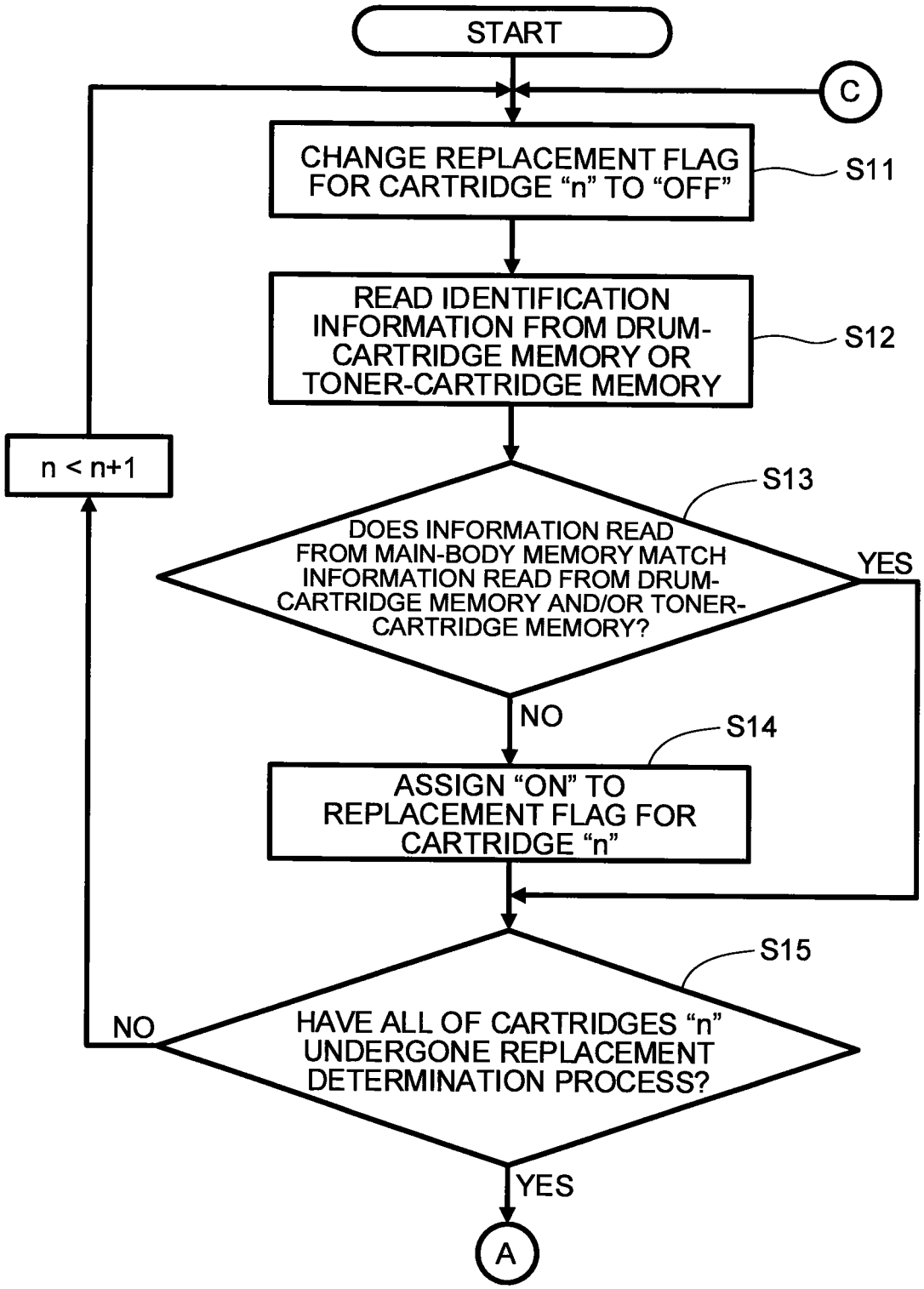
FIG. 4 is a flowchart of a determination process in the first illustrative embodiment according to one or more aspects of the disclosure.

Referring to FIG. 4, a determination process will be described. The controller 80 executes the determination process before executing printing. More specifically, for example, in the determination process, the controller 80 determines, with respect to each of the four drum cartridges 40 and the four toner cartridges 30, whether cartridge replacement has been performed. The controller 80 is configured to execute the determination process in response to the image forming apparatus 1 turning on from off or in response to the cover 12 being moved from the open position to the closed position while the power of the image forming apparatus 1 is on. In the following description, each of the drum cartridges 20 and the toner cartridges 30 may also be simply referred to as a "cartridge" without distinguishing therebetween.

The controller 80 changes a replacement flag for a cartridge "n" ("n" indicates a number that identifies a cartridge) as a determination target to OFF if the replacement flag for the determination target "n" has been assigned ON in the previous determination process (e.g., step S11). In the first illustrative embodiment, the image forming apparatus 1 includes a total of eight cartridges, and therefore, "n" indicates an integer between 1 and 8.

Subsequent to step S11, the controller 80 reads identification information (e.g., drum-cartridge identification information or toner-cartridge identification information) from a cartridge memory (e.g., the drum-cartridge memory 22 or the toner-cartridge memory 32) of the determination target "n" (e.g., step S12). More specifically, for example, in a case where the determination target "n" is one of the drum cartridges 20, in step S12, the controller 80 reads drum-cartridge identification information from the drum-cartridge memory 22 of the determination-target drum cartridge 20 currently attached to the frame 11 (e.g., a first reading process). In a case where the determination target "n" is one of the toner cartridges 30, in step S12, the controller 80 reads toner-cartridge identification information from the toner-cartridge memory 32 of the determination-target toner cartridge 30 currently attached to the frame 11 (e.g., a second reading process).

Subsequent to step S12, the controller 80 determines whether the currently-attached cartridge as the determination target "n" is different from the cartridge attached before the determination process starts (hereinafter, simply referred to as the previously-attached cartridge). In the first illustrative embodiment, a brand-new cartridge or a used cartridge may be used as a replacement cartridge. In step S13, the controller 80 also reads, from the main-body memory 82, the drum-cartridge identification information and the toner-cartridge identification information each about the determination target "n".

Thereafter, in step S13, in a case where the determination target "n" is one of the drum cartridges 20, the controller 80 determines whether the drum-cartridge identification information read from the main-body memory 82 matches the drum-cartridge identification information read from the drum-cartridge memory 22 in the first reading process (e.g., a first determination process). If the controller 80 determines that the drum-cartridge identification information read from the main-body memory 82 does not match the drum-cartridge identification information read from the drum-cartridge memory 22 in the first reading process, the controller 80 determines that the currently-attached cartridge as the determination target "n" is different from the previously-attached cartridge. That is, the controller 80 determines that cartridge replacement was performed. In step S13, in a case where the determination target "n" is one of the toner cartridges 30, the controller 80 determines whether the toner-cartridge identification information read from the main-body memory 82 matches the toner-cartridge identification information read from the toner-cartridge memory 32 in the second reading process (e.g., a second determination process). If the controller 80 determines that the toner-cartridge identification information read from the main-body memory 82 does not match the toner-cartridge identification information read in the second reading process, the controller 80 determines that the currently-attached cartridge as the determination target "n" is different from the previously-attached cartridge. That is, the controller 80 determines that cartridge replacement was performed.

If, in the first determination process or in the second determination process, the controller 80 determines that the currently-attached cartridge as the determination target "n" is different from the previously-attached cartridge (e.g., YES in step S13), the controller 80 determines that cartridge replacement was performed. The controller 80 thus assigns ON to the replacement flag for the determination target "n" (e.g., step S14). If, in the first determination process or in the second determination process, the controller 80 determines that the currently-attached cartridge as the determination target "n" is the same cartridge as before (e.g., NO in step S13), the controller 80 determines that cartridge replacement has not been performed. The controller 80 thus might not change the replacement flag for the determination target "n" from OFF to ON.

Based on a negative determination (e.g., "NO") in step S13 or subsequent to step S14, the controller 80 determines whether all of the cartridges "n" identified by the numbers 1 to 8 have undergone the determination process (e.g., steps S11 to S14) (e.g., step S15). If the controller 80 determines that all of the cartridges "n" identified by the numbers 1 to 8 have undergone the determination process (e.g., YES in step S15), the routine proceeds to step S21 (refer to FIG. 5). More specifically, the controller 80 executes a replacement error detection process. If the controller 80 determines that one or more cartridges "n" have not undergone the determination process (e.g., NO in step S15), the controller 80 increments the value assigned to "n" that identifies a cartridge by one (n+1) to change the determination target and executes steps S11 to S15 again. In other words, the controller 80 repeats steps S11 to S15 until the controller 80 determines that all of the cartridges "n" identified by the numbers 1 to 8 have undergone the determination process.

1-2-3. Replacement Time Determination Process and Error Notification Process

Figure 5:
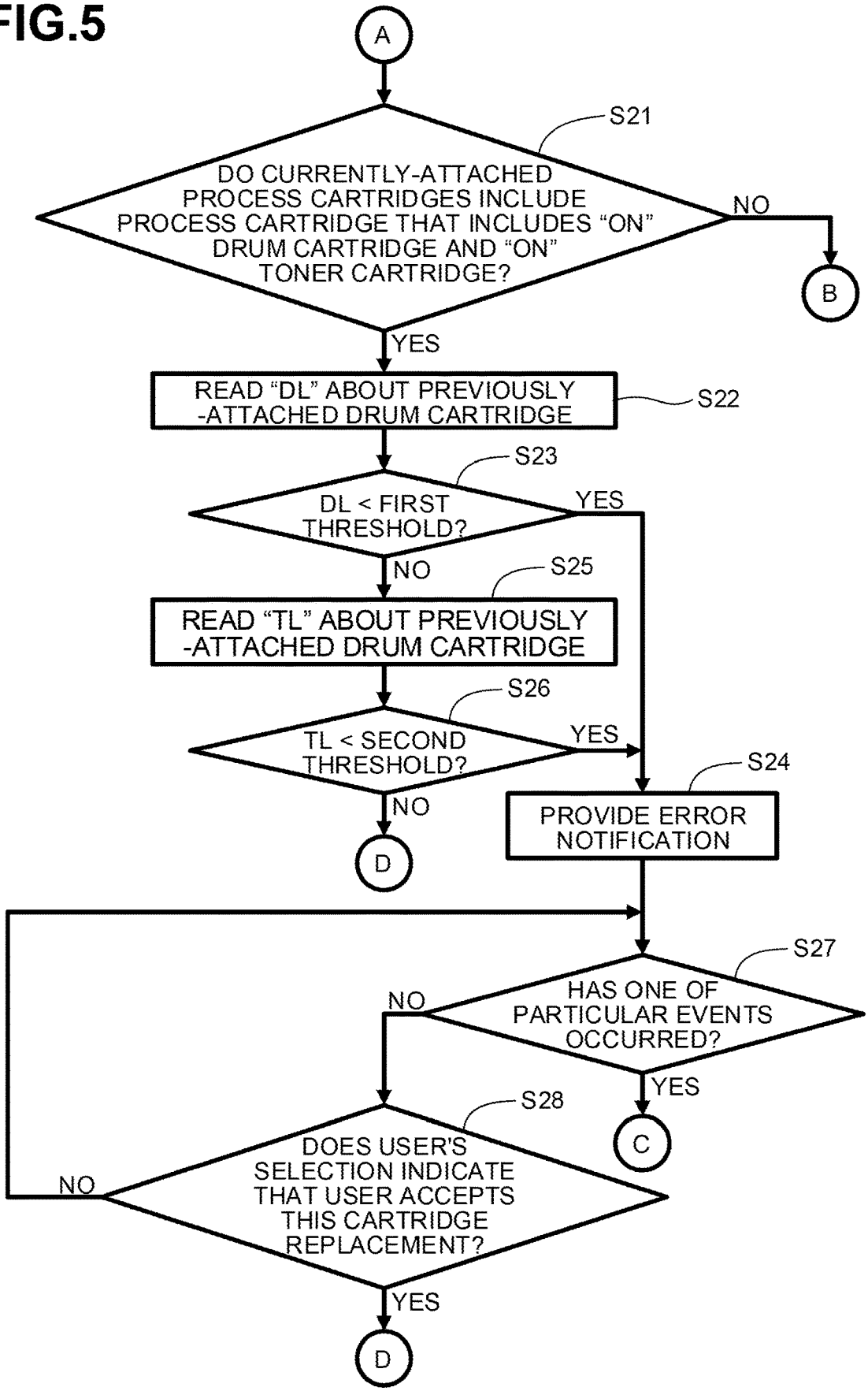
FIG. 5 is a flowchart of a replacement error detection process in the first illustrative embodiment according to one or more aspects of the disclosure.

Based on a positive determination (e.g., "YES") in step S15 (refer to FIG. 4), the controller 80 executes the replacement time determination process and the error notification process (refer to FIG. 5). In the replacement time determination process, for example, the controller 80 detects unnecessary cartridge replacement. In the error notification process, for example, the controller 80 causes at least one of the display 90 and the speaker 95 to provide error notification. The unnecessary cartridge replacement may occur when a user replaced both of the drum cartridge 20 and the toner cartridge 30 of the process cartridge with respective replacement cartridges although only one of the drum cartridge 20 and the toner cartridge 30 needs replacement but the other might not need replacement. In one example, the controller 80 detects unnecessary cartridge replacement in a case where the user has replaced the toner cartridge 30 with a replacement toner cartridge 30 by mistake in the process cartridge although only the drum cartridge 20 needs replacement in the process cartridge but the other might not need replacement. In another example, the controller 80 detects unnecessary cartridge replacement in a case where the user has replaced the drum cartridge 20 with a replacement drum cartridge 20 by mistake in the process cartridge although only the toner cartridge 30 needs replacement in the process cartridge.

In step S21, the controller 80 determines whether the currently-attached process cartridges include the process cartridge that includes the drum cartridge 20 and the toner cartridge 30 whose replacement flags are both ON (e.g., step S21). Hereinafter, a cartridge whose replacement flag is ON may be referred to as an "ON" cartridge, and a cartridge whose replacement flag is OFF may be referred to as an "OFF cartridge. In step S21, the controller 80 determines whether the currently-attached process cartridges include the process cartridge that includes the drum cartridge 20 and the toner cartridge 30 whose replacement flags are both ON (e.g., step S21). Hereinafter, a cartridge whose replacement flag is ON may be referred to as an "ON" cartridge, and a cartridge whose replacement flag is OFF may be referred to as an "OFF cartridge. If the controller 80 determines that the currently-attached process cartridges do not include the process cartridge that includes the "ON" drum cartridge 20 and the "ON" toner cartridge 30 (e.g., NO in step S21), the routine proceeds to step S31 (refer to FIG. 6). That is, the controller 80 executes the printing preparation process. If the controller 80 determines that the currently-attached process cartridges include at least one process cartridge that includes the "ON" drum cartridge 20 and the "ON" toner cartridge 30 (e.g., YES in step S21), the controller 80 determines whether any of the "ON" cartridges (e.g., the "ON" drum cartridge 20 and the "ON" toner cartridge 30) of the at least one process cartridge has been replaced with a replacement cartridge by user's mistake. More specifically, for example, the controller 80 executes subsequent steps (e.g., steps S22 to S28).

Based on a positive determination (e.g., "YES") in step S21, the controller 80 determines whether the drum cartridge replacement is appropriate (i.e., whether the previously-attached drum cartridge 20 should have been replaced with another drum cartridge 20). More specifically, for example, the controller 80 reads, from the main-body memory 82, the drum-cartridge life information DL about a previously-attached drum cartridge 20 replaced with the currently-attached "ON" drum cartridge 20. If, in step S21, the controller 80 determines that the currently-attached process cartridges include two or more process cartridges that each include the "ON" drum cartridge 20 and the "ON" toner cartridge 30, in step S22, the controller 80 obtains the drum-cartridge life information DL about each of two or more previously-attached drum cartridges 20 replaced with the two or more currently-attached "ON" drum cartridges 20 (e.g., step S22). The controller 80 also reads a first threshold Th1 from the main-body memory 82. The first threshold Th1 may relate to the life of drum cartridges. The controller 80 then compares each of the at least one piece of the drum-cartridge life information DL read from the main-body memory 82 with the first threshold Th1 (e.g., step S23: first replacement time determination process).

Figure 7:
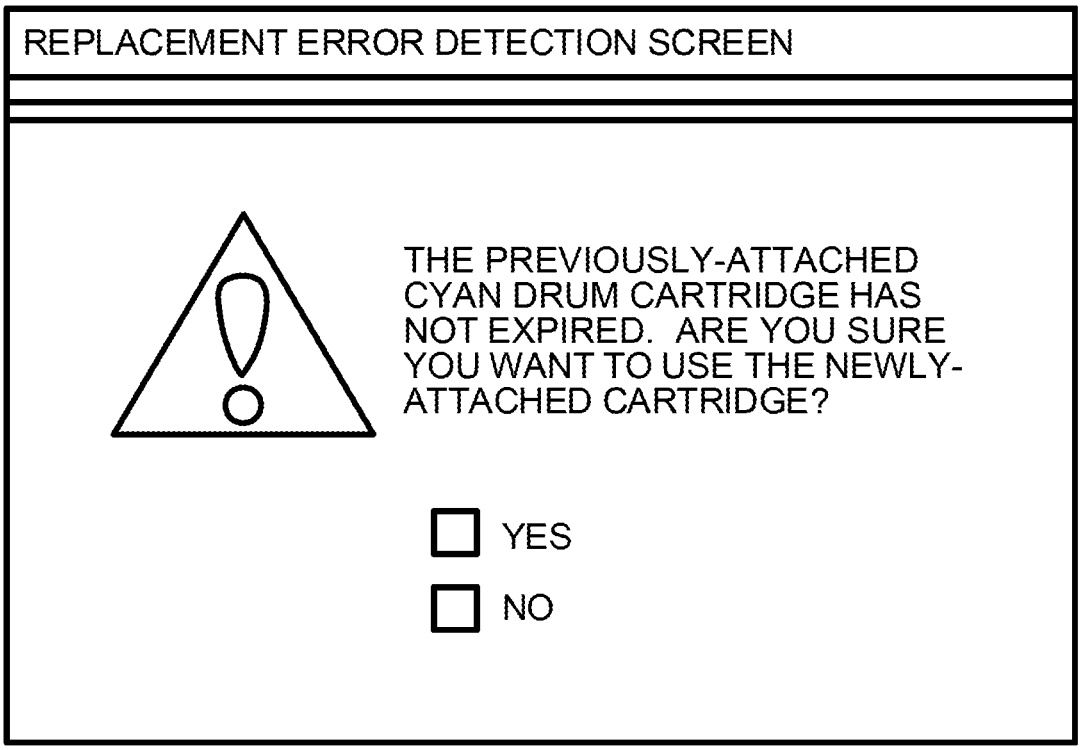
FIG. 7 illustrates an example of a message to be displayed on a display in the first illustrative embodiment according to one or more aspects of the disclosure.

For example, the drum-cartridge life information DL read from the main-body memory 82 may have been updated in the update process. The drum-cartridge life information DL may indicate, for example, the total number of rotations of a photosensitive drum 21 in a corresponding drum cartridge 20. The first threshold Th1 may be, for example, an upper limit for the total number of rotations of a photosensitive drum 21. If the controller 80 determines that the drum-cartridge life information DL indicates a value smaller than the first threshold Th1, the controller 80 determines that this cartridge replacement is inappropriate (i.e., the previously-attached drum cartridge 20 should not have been replaced with the currently-attached drum cartridge 20). In other words, the controller 80 determines that the drum cartridge replacement was performed by user's mistake although the previously-attached drum cartridge 20 has not reached its replacement time. If, in step S23, the controller 80 makes a positive determination (e.g., "YES") with respect to at least one of the at least one previously-attached drum cartridge 20 (e.g., YES in step S23), the controller 80 causes the display 90 and the speaker 95 to provide error notification (e.g., step S24: first error notification process). More specifically, for example, the controller 80 displays a message on the display 90 (refer to FIG. 7). As illustrated in FIG. 7, for example, the message may prompt the user to select one of options "YES" and "NO". The one option "YES" may indicate, for example, that the user intends to use the at least one newly-attached cartridge, that is, the user accepts this cartridge replacement. The other option "NO" may indicate, for example, that the user intends to detach the at least one newly-attached cartridge from the frame 11 and attach back the at least one previously-attached cartridge to the frame 11, that is, the user does not accept this cartridge replacement. In the first illustrative embodiment, for example, checkboxes may be used for allowing the user to indicate his/her selection. Nevertheless, in other embodiments, for example, any known method for allowing the user to indicate his/her selection may be available.

In the first illustrative embodiment, the controller 80 generates verbal output to read aloud text from the message or a warning sound via the speaker 95 in addition to displaying the message on the display 90. The text read aloud from the message may be the same as the text in the message displayed on the display 95. Such notification may thus enable the user to readily recognize that the user need to determine again the appropriateness of this cartridge replacement.

If the controller 80 determines that the drum-cartridge life information DL indicates a value greater than or equal to the first threshold Th1, the controller 80 determines that this cartridge replacement is appropriate. In other words, the controller 80 determines that the drum cartridge replacement was performed because the previously-attached drum cartridge 20 has reached its replacement time.

If, in step S23, the controller 80 makes a negative determination (e.g., "NO") with respect to all of the at least one previously-attached drum cartridge 20 (e.g., NO in step S23), the controller 80 then determines, with respect to each of at least one "ON" toner cartridge 30, whether the toner cartridge replacement is appropriate. More specifically, for example, the controller 80 reads, from the main-body memory 82, the toner-cartridge life information TL about a previously-attached toner cartridge 30 replaced with the currently-attached "ON" toner cartridge 30. If, in step S21, the controller 80 determines that the currently-attached process cartridges include two or more process cartridges that each include the "ON" drum cartridge 20 and the "ON" toner cartridge 30, in step S25, the controller 80 obtains the toner-cartridge life information TL about each of two or more previously-attached toner cartridges 30 replaced with the two or more currently-attached "ON" toner cartridges 30 (e.g., step S25). The controller 80 also reads a second threshold Th2 from the main-body memory 82. The second threshold Th2 may relate to the life of toner cartridges. The controller 80 then compares each of the at least one piece of the toner-cartridge life information TL read from the main-body memory 82 with the second threshold Th2 (e.g., step S26: second replacement time determination process).

For example, the toner-cartridge life information TL read from the main-body memory 82 may have been updated in the update process. The toner-cartridge life information TL may indicate, for example, the total number of rotations of a developing roller 31 in a corresponding toner cartridge 30. The second threshold Th2 may be, for example, an upper limit for the total number of rotations of a developing roller 31. If the controller 80 determines that the toner-cartridge life information TL indicates a value smaller than the second threshold Th2, the controller 80 determines that this cartridge replacement is inappropriate. In other words, the controller 80 determines that the toner cartridge replacement was performed by user's mistake although the previously-attached toner cartridge 30 has not reached its replacement time. If, in step S26, the controller 80 makes a positive determination (e.g., "YES") with respect to at least one of the at least one previously-attached toner cartridge 30 (e.g., YES in step S26), the controller 80 causes the display 90 and the speaker 95 to provide error notification (e.g., step S24: second error notification process). In the second error notification process, the error notification may be implemented in the same or similar manner as the manner of the first error notification process.

If the controller 80 determines that the toner-cartridge life information TL indicates a value greater than or equal to the second threshold Th2, the controller 80 determines that this cartridge replacement is appropriate. In other words, the controller 80 determines that the toner cartridge replacement was performed because the previously-attached toner cartridge 30 has reached its replacement time. If, in step S26, the controller 80 makes a negative determination (e.g., "NO") with respect to all of the at least one previously-attached toner cartridge 30 (e.g., NO in step S26), the controller 80 thus determines that the replacement of the drum cartridge 20 and the toner cartridge 30 in each of the at least one process cartridge is appropriate. The controller 80 then executes the printing preparation process.

If the controller 80 determines that the replacement of one of the at least one drum cartridge 20 and the at least one toner cartridge 30 is inappropriate (e.g., YES in step S23 or YES in step S26), the controller 80 executes one of the first error notification process and the second error notification process (e.g., step S24). More specifically, in one example, if the controller 80 determines that the replacement of all of the at least one drum cartridge 20 is appropriate but the replacement of at least one of the at least one toner cartridge 30 is inappropriate, the controller 80 executes the second error notification process (e.g., step S24). In another example, if the controller 80 determines that the replacement of at least one of the at least one drum cartridge 20 is inappropriate, the controller 80 executes the first error notification process (e.g., step S24) without determining the appropriateness of the toner cartridge replacement. Subsequent to step S24, the controller 80 determines whether one of particular events has occurred (e.g., step S27). The particular events include, for example, turning-on of the power of the image forming apparatus 1 after turning off, and the positional change of the cover 12 to the closed position from the open position while the power of the image forming apparatus 1 is on. If the controller 80 determines that one of the particular events has occurred (e.g., YES in step S27), the routine goes back to step S11. The controller 80 thus executes the determination process and the replacement error detection process. That is, in step S27, the controller 80 determines whether the replacement error has been corrected.

If the controller 80 determines that none of the particular events has occurred (e.g., NO in step S27), the controller 80 causes the display 95 to display a message. The message may be an inquiry about whether the replacement of the one or more cartridges having the replacement error is accepted (e.g., step S28). More specifically, for example, the message may prompt the user to select one option from among a plurality of options. A first option may indicate, for example, that the user intends to use all of the at least one newly-attached cartridge, that is, the user accepts this cartridge replacement. A second option may indicate that the user intends to detach the at least one newly-attached cartridge from the frame 11 and attach back the at least one previously-attached cartridge to the frame 11, that is, the user does not accept this cartridge replacement. If the controller 80 determines that the user's selection indicates that the user accepts this cartridge replacement (e.g., YES in step S28), the controller 80 executes the printing preparation process. If the controller 80 determines that the user's selection indicates that the user does not accept this cartridge replacement (e.g., NO in step S28), the routine might not proceed until the controller 80 determines that one of the particular events has occurred (e.g., YES in step S27).

1-2-4. First Storing Process and Second Storing Process

Figure 6:
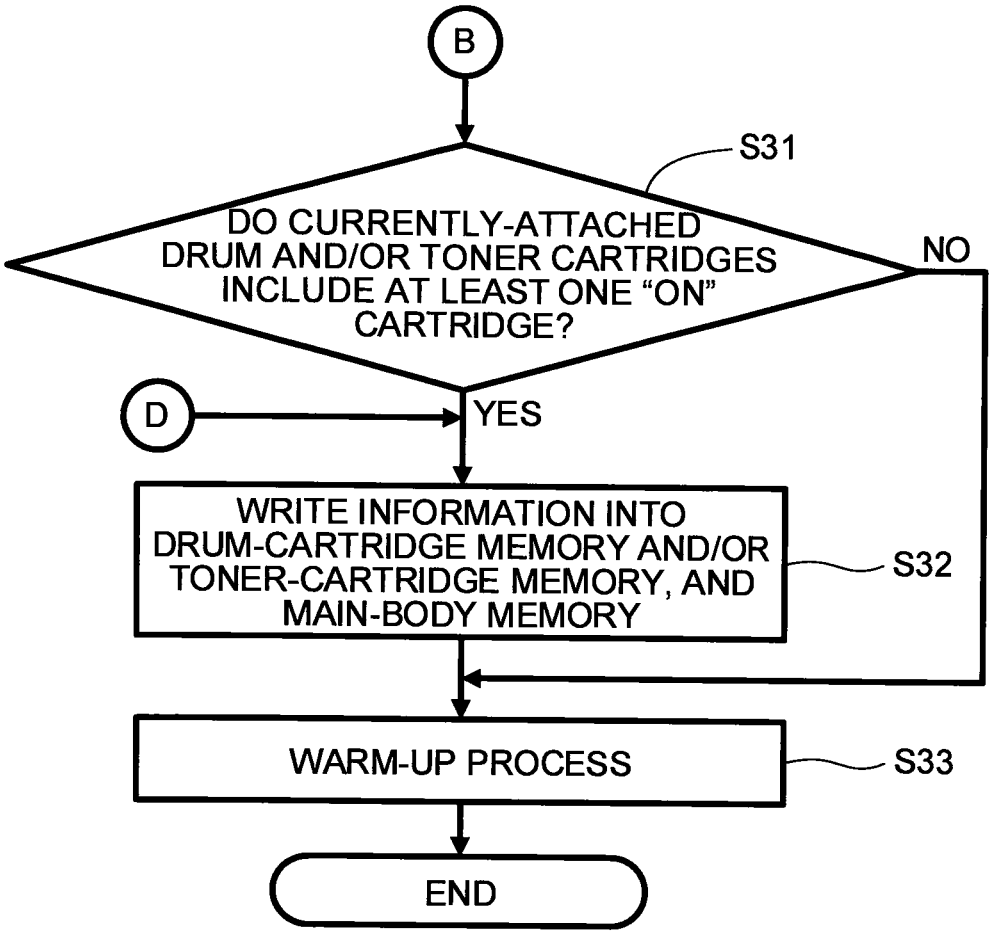
FIG. 6 is a flowchart of a printing preparation process in the first illustrative embodiment according to one or more aspects of the disclosure.

Based on a negative determination (e.g., "NO") in step S21 (refer to FIG. 5), a negative determination (e.g., "NO") in step S26 (refer to FIG. 5), or a positive determination (e.g., "YES") in step S28 (refer to FIG. 5), the controller 80 may execute a first storing process and/or a second storing process (refer to FIG. 6). That is, the controller 80 executes the first storing process and/or the second storing process after the determination process and the error notification process.

If the controller 80 determines that the currently-attached process cartridges do not include the process cartridge that includes the "ON" drum cartridge 20 and the "ON" toner cartridge 30 (e.g., NO in step S21), the controller 80 determines whether the replacement flag for any cartridge in any process cartridge is ON (e.g., step S31). More specifically, for example, the controller 80 determines whether the currently-attached four drum cartridges 20 include at least one "ON" drum cartridge 20. If, in step S31, the controller 80 determines that the currently-attached four drum cartridges 20 include at least one "ON" drum cartridge 20 (e.g., YES in step S31), the controller 80 determines that the at least one "ON" drum cartridge 20 is a newly-attached drum cartridge 20. In such a case, the controller 80 reads the drum-cartridge identification information and the drum-cartridge life information from the drum-cartridge memory 22 of each of the at least one "ON" drum cartridge 20 in the frame 11. The controller 80 then writes the read information into the main-body memory 82 (e.g., step S32: first storing process). With respect to the at least one drum cartridge 20, the controller 80 erases information indicating that the drum cartridge 20 is a "brand new cartridge" from the main-body memory 82 and the drum-cartridge memory 22, and writes information indicating that the drum cartridge 20 is a "used cartridge" into the main-body memory 82 and the drum-cartridge memory 22.

Further, in step S31, the controller 80 determines whether the currently-attached four toner cartridges 30 include at least one "ON" toner cartridge 30. If, in step S31, the controller 80 determines that the currently-attached four toner cartridges 30 include at least one "ON" toner cartridge 30 (e.g., YES in step S31), the controller 80 determines that the at least one "ON" toner cartridge 30 is a newly-attached toner cartridge 30. In such a case, the controller 80 reads the toner-cartridge identification information and the toner-cartridge life information from the toner-cartridge memory 32 of each of the at least one "ON" toner cartridge 30 in the frame 11. The controller 80 then writes the read information into the main-body memory 82 (e.g., step S32: second storing process). With respect to the at least one toner cartridge 30, the controller 80 erases information indicating that the toner cartridge 30 is a "brand new cartridge" from the main-body memory 82 and the toner-cartridge memory 32, and writes information indicating that the toner cartridge 30 is a "used cartridge" into the main-body memory 82 and the toner-cartridge memory 32.

1-2-5. Printing Preparation Process

After executing the first storing process and/or the second storing process (e.g., subsequent to step S32) or based on a negative determination (e.g., "NO") in step S31, the controller 80 executes the printing preparation process (i.e., the warm-up process) (refer to FIG. 6) (e.g., step S33). More specifically, for example, in step S33, the controller 80 causes a fan of the image forming apparatus 1 to rotate, causes a heater of the fixing unit to be preheated, determines whether each sensor is in failure, and checks the temperature in the casing 10 using a temperature sensor. By doing so, the printing preparation process is completed.

According to the first illustrative embodiment, if the controller 80 determines that the currently-attached process cartridges include at least one process cartridge that includes the "ON" drum cartridge 20 and the "ON" toner cartridge 30 (i.e., the drum cartridge 20 and the toner cartridge 30 are both newly-attached cartridges), the controller 80 executes the first replacement time determination process or both of the first and second replacement time determination processes. In the first replacement time determination process, the controller 80 determines whether the drum cartridge replacement is necessary. In the second replacement time determination process, the controller 80 determines whether the toner cartridge replacement is necessary. If the controller 80 determines the drum cartridge replacement and the toner cartridge replacement are both not necessary, the controller 80 causes at least one of the display 90 and the speaker 95 to provide error notification. Such notification may thus enable the user to recheck appropriateness of the drum cartridge replacement and the toner cartridge replacement.

According to the first illustrative embodiment, the controller 80 sets the first threshold Th1 and the second threshold Th2. The controller 80 may compare the drum-cartridge life information and the toner-cartridge life information with the first threshold Th1 and the second threshold Th2, respectively. The controller 80 may thus determine, based on the comparison result, whether the drum cartridge replacement is necessary or whether the drum cartridge replacement and the toner cartridge replacement are both necessary.

According to the first illustrative embodiment, if, in the first replacement time determination process, the controller 80 determines that the previously-attached drum cartridge 20 has not reached its replacement time, the controller 80 might not write the drum-cartridge life information and the drum identification information read from the drum-cartridge memory 22 of the newly-attached drum cartridge 20 in the frame 11, into the main-body memory 82 and the drum-cartridge memory 22 of the newly-attached drum cartridge 20. Similarly, if, in the second replacement time determination process, the controller 80 determines that the previously-attached toner cartridge 30 has not reached its replacement time, the controller 80 might not write the toner-cartridge life information and the toner identification information read from the toner-cartridge memory 32 of the newly-attached toner cartridge 30 in the frame 11, into the main-body memory 82 and the toner-cartridge memory 32 of the newly-attached toner cartridge 30. Such a configuration may thus enable the brand-new cartridge that has been attached to the frame 11 by user's mistake but not been used yet to be prevented from being labeled as a used cartridge.

According to the first illustrative embodiment, only if the controller 80 determines that the currently-attached process cartridges include at least one process cartridge that includes the "ON" drum cartridge 20 and the "ON" toner cartridge 30 (i.e., the drum cartridge 20 and the toner cartridge 30 are both newly-attached cartridges), the controller 80 executes the first replacement time determination process or both of the first and second replacement time determination processes. Such a configuration may reduce steps and prevent execution of unnecessary steps.

According to the first illustrative embodiment, the controller 80 displays the message on the display 90 to allow the user to select one of the options as to whether the user accepts the cartridge replacement. Such a configuration may thus enable the user to select one of the option that the user intends to use all of the at least one newly-attached cartridge and the option that the user intends to attach back the at least one previously-attached cartridge to the frame 11.

2. Second Illustrative Embodiment

Figure 8:
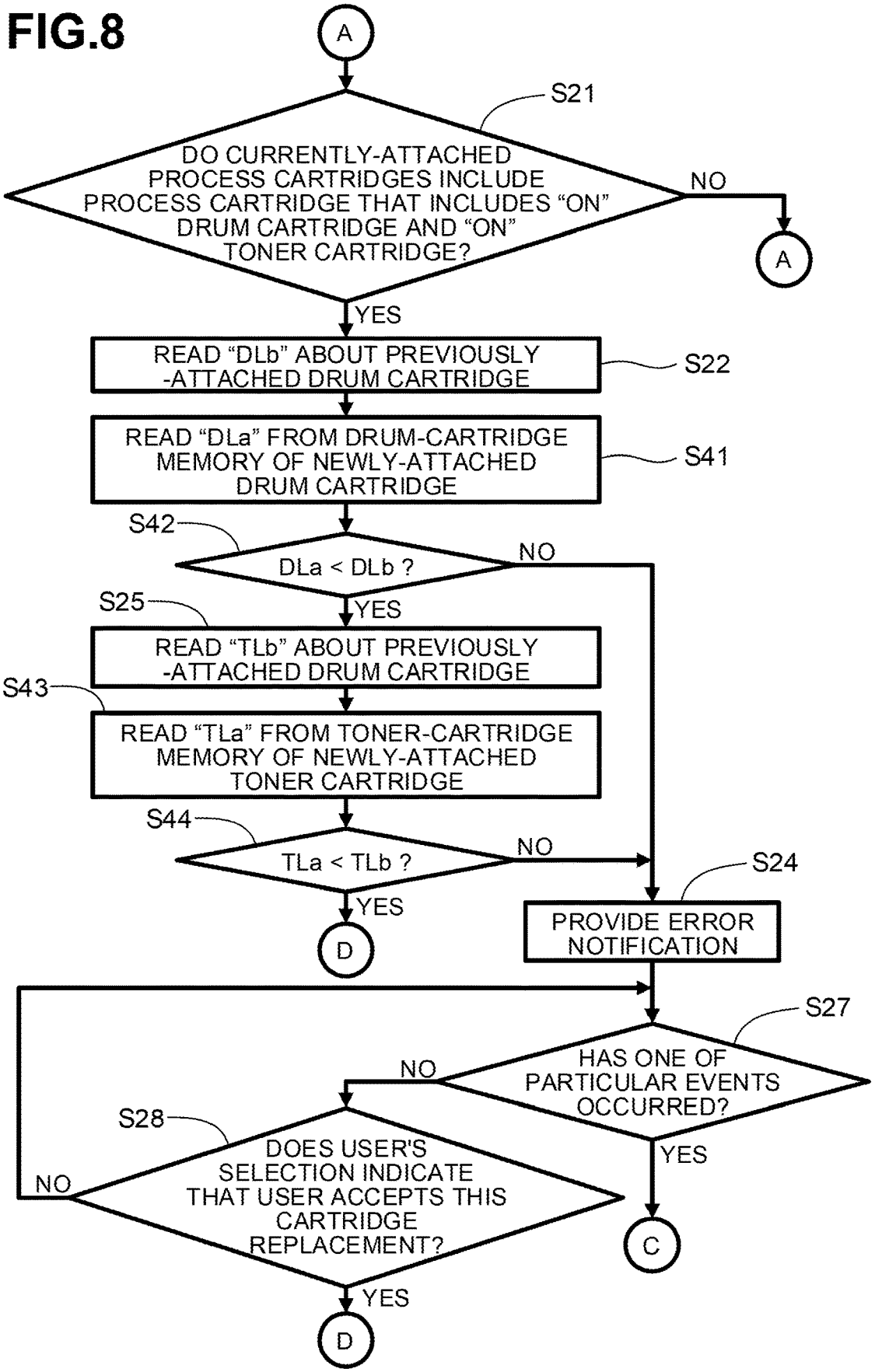
FIG. 8 is a flowchart of a replacement error detection process in a second illustrative embodiment according to one or more aspects of the disclosure.

Referring to FIG. 8, a second illustrative embodiment will be described. An image forming apparatus 1 according to the second illustrative embodiment may have the same or similar configuration to the image forming apparatus 1 according to the first illustrative embodiment. Accordingly, a description will be given mainly for the components/elements different from the first illustrative embodiment, and a description will be omitted for the common components/elements by assigning the same reference numerals thereto. In the second illustrative embodiment, details of processes to be executed by the controller 80 may be partially different from those according to the first illustrative embodiment. Therefore, common steps have the same step numbers as those of the first illustrative embodiment, and the detailed description of the common steps will be omitted.

In the second illustrative embodiment, the controller 80 executes an update process, a determination process, and a print preparation process similar to those executed in the first illustrative embodiment. Nevertheless, in the second illustrative embodiment, the controller 80 executes a replacement error detection process of FIG. 8 instead of the replacement error detection process of FIG. 5 executed in the first illustrative embodiment.

2-1. Error Notification Process

The controller 80 executes steps S41 and S42 instead of step S23 executed in the first illustrative embodiment. The controller 80 further executes steps S43 and S44 instead of step S26 executed in the first illustrative embodiment.

If the controller 80 determines that the currently-attached process cartridges include at least one process cartridge that includes the "ON" drum cartridge 20 and the "ON" toner cartridge 30 (e.g., YES in step S21), the controller 80 determines whether the drum cartridge replacement is appropriate. More specifically, for example, the controller 80 reads, from the main-body memory 82, the drum-cartridge life information DL about a previously-attached drum cartridge 20 replaced with the currently-attached "ON" drum cartridge 20. If, in step S21, the controller 80 determines that the currently-attached process cartridges include two or more process cartridges that each include the "ON" drum cartridge 20 and the "ON" toner cartridge 30, in step S22, the controller 80 obtains the toner-cartridge life information TL about each of two or more previously-attached drum cartridges 20 replaced with the two or more currently-attached "ON" drum cartridges 20 (e.g., step S22).

The controller 80 then obtains the drum-cartridge life information DLa with respect to each of the at least one newly-attached drum cartridge 20 that is a replacement for the previously-attached drum cartridge 20. More specifically, for example, the controller 80 reads the drum-cartridge life information DLa from the drum-cartridge memory 22 of each of the at least one newly-attached drum cartridge 20 in the frame 11 (e.g., step S41). The controller 80 then compares each of the at least one piece of the drum-cartridge life information DLb read from the main-body memory 82 with a corresponding one of the at least one piece of the drum-cartridge life information DLa read from the drum-cartridge memory 22 of each of the at least one newly-attached drum cartridge 20 (e.g., step S42: first replacement time determination process).

Each of the drum-cartridge life information DLb and DLa may be, for example, the total number of rotations of a photosensitive drum 21 in a corresponding drum cartridge 20. If the controller 80 determines that the drum-cartridge life information DLa about the newly-attached drum cartridge 20 indicates a value greater than or equal to the drum-cartridge life information DLb about the previously-attached drum cartridge 20 replaced with the newly-attached drum cartridge 20, the controller 80 determines that this drum cartridge replacement is inappropriate. In other words, the controller 80 determines that the newly-attached drum cartridge 20 has a shorter life than the previously-attached drum cartridge 20. If, in step S42, the controller 80 makes a negative determination (e.g., "NO") with respect to at least one of the at least one drum cartridge 20 (e.g., NO in step S42), the controller 80 causes the display 90 and the speaker 95 to provide error notification (e.g., step S24: first error notification process).

If the controller 80 determines that the drum-cartridge life information DLa about the newly-attached drum cartridge 20 indicates a value smaller than the drum-cartridge life information DLb about the previously-attached drum cartridge 20 replaced with the newly-attached drum cartridge 20, the controller 80 determines that this drum cartridge replacement is appropriate. In other words, the controller 80 determines that the newly-attached drum cartridge 20 has a longer life than the previously-attached drum cartridge 20. That is, the controller 80 determines that this drum cartridge replacement is appropriate.

If, in step S42, the controller 80 makes a positive determination (e.g., "YES") with respect to all of the at least one drum cartridge 20 (e.g., YES in step S42), the controller 80 then determines whether the toner cartridge replacement is appropriate. More specifically, for example, the controller 80 reads, from the main-body memory 82, the toner-cartridge life information TLb about a previously-attached toner cartridge 30 replaced with the currently-attached "ON" toner cartridge 30. If, in step S21, the controller 80 determines that the currently-attached process cartridges include two or more process cartridges that each include the "ON" drum cartridge 20 and the "ON" toner cartridge 30, in step S25, the controller 80 obtains the toner-cartridge life information TLb about each of two or more previously-attached toner cartridges 30 replaced with the two or more currently-attached "ON" toner cartridges 30 (e.g., step S22).

The controller 80 then reads the toner-cartridge life information TLa from the toner-cartridge memory 32 of each of the at least one newly-attached toner cartridge 30 in the frame 11 (e.g., step S43). If, in step S21, the controller 80 determines that the currently-attached process cartridges include two or more process cartridges that each include the "ON" drum cartridge 20 and the "ON" toner cartridge 30, in step S43, the controller 80 obtains the toner-cartridge life information TLa about each of two or more newly-attached toner cartridges 30 that are replacements for the two or more previously-attached "ON" toner cartridges 30 (e.g., step S43). The controller 80 then compares each of the at least one piece of the toner-cartridge life information TLb read from the main-body memory 82 with a corresponding one of the at least one piece of the toner-cartridge life information TLa read from the toner-cartridge memory 32 of each of the at least one newly-attached toner cartridge 30 (e.g., step S44: second replacement time determination process).

Each of the toner-cartridge life information TLb and TLa may be, for example, the total number of rotations of a developing roller 31 in a corresponding toner cartridge 30. If the controller 80 determines that the toner-cartridge life information TLa about the newly-attached toner cartridge 30 indicates a value greater than or equal to the toner-cartridge life information TLb about the previously-attached toner cartridge 30 corresponding to the newly-attached toner cartridge 30, the controller 80 determines that this toner cartridge replacement is inappropriate. In other words, the controller 80 determines that the newly-attached toner cartridge 30 has a shorter life than the previously-attached toner cartridge 30. If, in step S44, the controller 80 makes a negative determination (e.g., "NO") with respect to at least one of the at least one toner cartridge 30 (e.g., NO in step S44), the controller 80 causes the display 90 and the speaker 95 to provide error notification (e.g., step S44: second error notification process).

If the controller 80 determines that the toner-cartridge life information TLa about the newly-attached toner cartridge 30 indicates a value smaller than the toner-cartridge life information TLb about the previously-attached toner cartridge 30 replaced with the newly-attached toner cartridge 30, the controller 80 determines that this toner cartridge replacement is appropriate. In other words, the controller 80 determines that the newly-attached toner cartridge 30 has a longer life than the previously-attached toner cartridge 30. That is, the controller 80 determines that this toner cartridge replacement is appropriate. In such a case, the controller 80 determines that the drum cartridge replacement and the toner cartridge replacement are both appropriate. If, in step S44, the controller 80 makes a positive determination (e.g., "YES") with respect to all of the at least one toner cartridge 30 (e.g., YES in step S42), the controller 80 executes the print preparation process.

According to the second illustrative embodiment, as described above, if the controller 80 determines that the newly-attached cartridge has a shorter life than the previously-attached cartridge, the controller 80 may determine that the previously-attached cartridge has not reached its replacement time, that is, the cartridge replacement is inappropriate.

3. Third Illustrative Embodiment

Referring to FIGS. 9 to 14, a third illustrative embodiment will be described. An image forming apparatus 1 according to the third illustrative embodiment may have the same or similar configuration to the image forming apparatus 1 according to the first illustrative embodiment. Accordingly, a description will be given mainly for the components/elements different from the first illustrative embodiment, and a description will be omitted for the common components/elements by assigning the same reference numerals thereto. In the third illustrative embodiment, details of processes to be executed by the controller 80 may be partially different from those according to the first illustrative embodiment. Therefore, common steps have the same step numbers as those of the first illustrative embodiment, and the detailed description of the common steps will be omitted.

In the third illustrative embodiment, the controller 80 executes an update process, a determination process, and a print preparation process similar to those executed in the first illustrative embodiment. Nevertheless, in the third illustrative embodiment, the controller 80 executes a replacement error detection process of FIGS. 9 to 12 instead of the replacement error detection process of FIG. 5 executed in the first illustrative embodiment.

3-1. Error Notification Process

In the first illustrative embodiment, if the controller 80 determines that the currently-attached process cartridges include at least one process cartridge that includes the "ON" drum cartridge 20 and the "ON" toner cartridge 30 (i.e., the drum cartridge 20 and the toner cartridge 30 are both newly-attached cartridges), the controller 80 executes the replacement error detection process. Nevertheless, in the third illustrative embodiment, the controller 80 executes the replacement error detection process on all of the currently-attached cartridges. The currently-attached cartridges may include newly-attached cartridges and non-replaced cartridges. That is, the controller 80 determines, with respect to each of the cartridges, whether a remaining life immediately before the cartridge replacement was performed is greater than a particular threshold.

Figure 9:
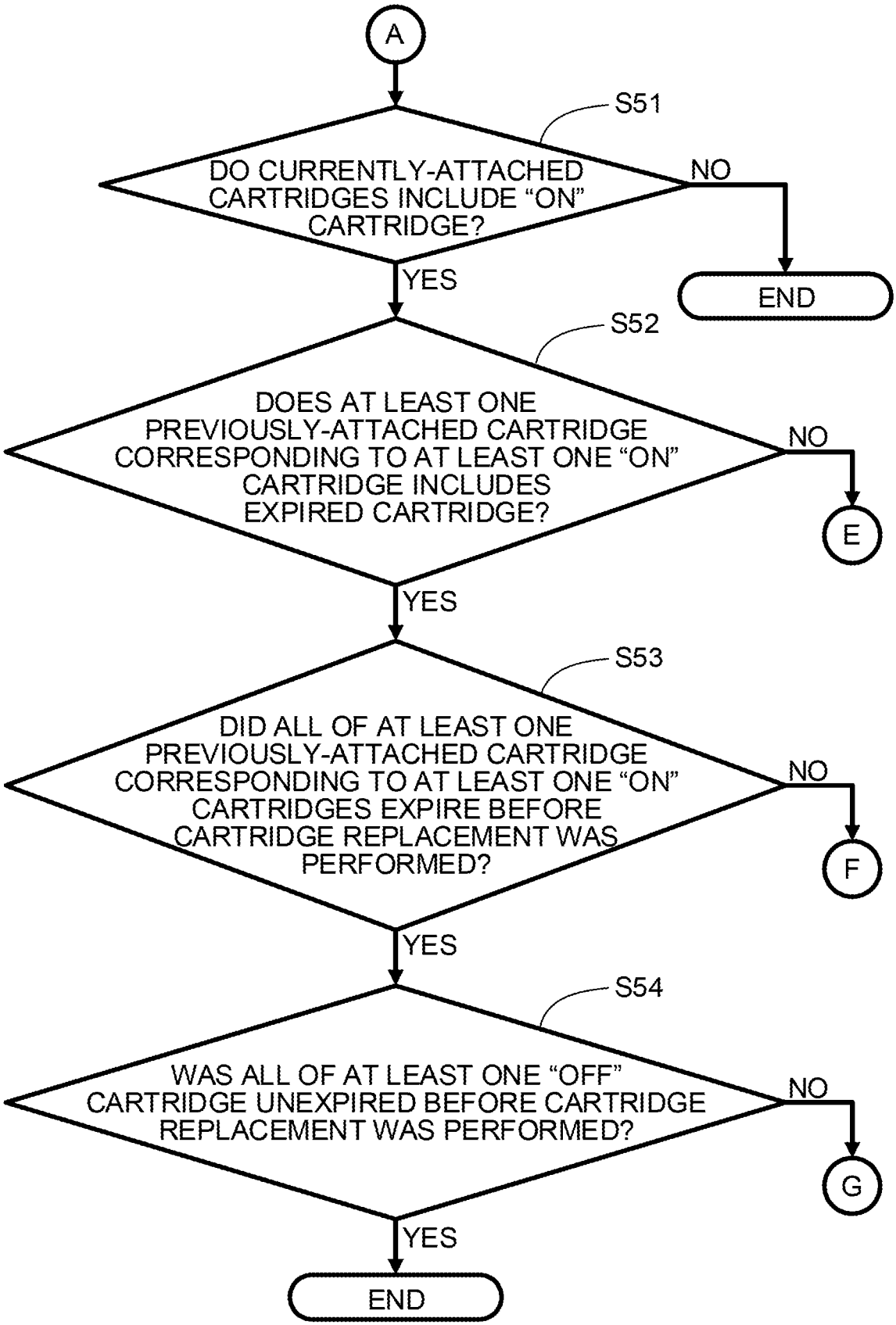
FIG. 9 is a flowchart of a replacement error detection process in a third illustrative embodiment according to one or more aspects of the disclosure.
Figure 12:
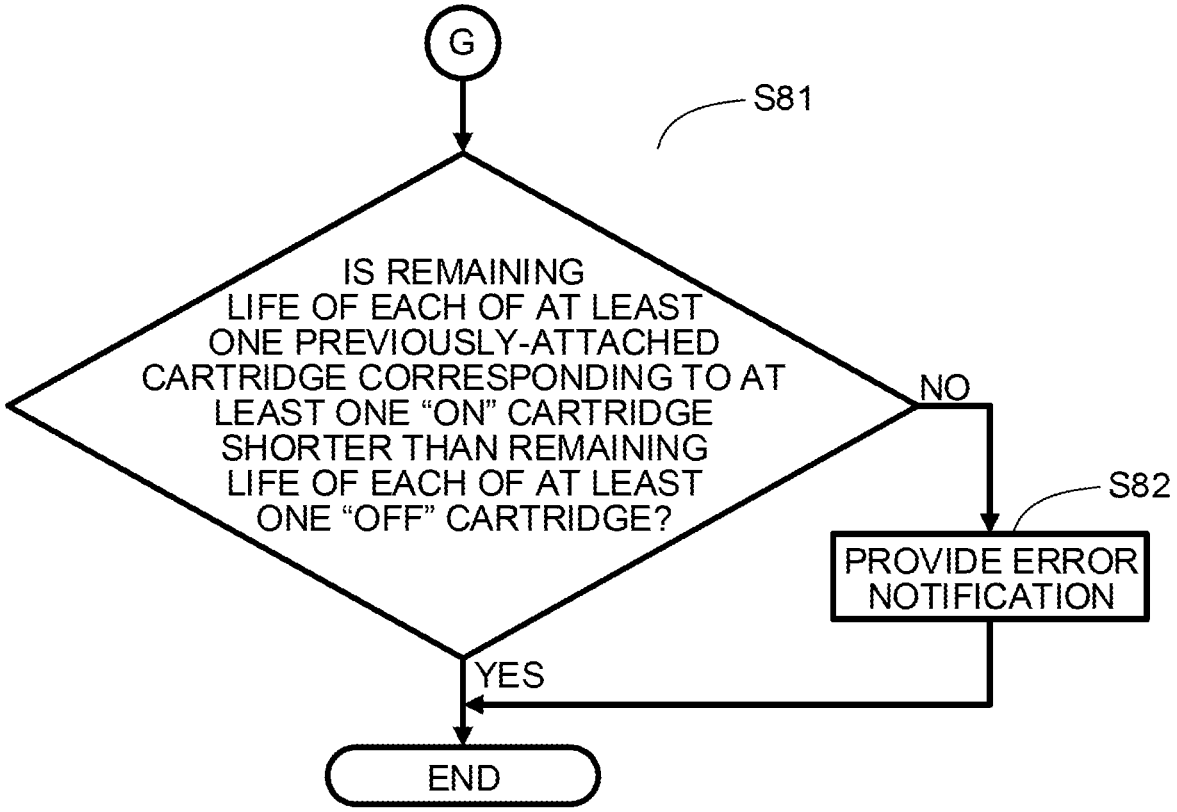
FIG. 12 is a continuation of the flowchart of FIG. 9 in the third illustrative embodiment according to one or more aspects of the disclosure.

Referring to FIGS. 9 and 12, the replacement error detection process according to the third illustrative embodiment will be described. The controller 80 determines whether the currently-attached cartridges (e.g., the four drum cartridges 20 and the four toner cartridges 30) include at least one newly-attached cartridge (e.g., step S51). More specifically, for example, the controller 80 determines whether the replacement flag for any cartridge "n" (e.g., "n" indicates an integer between 1 and 8) is ON. In other words, the controller 80 determines whether the currently-attached cartridges include at least one "ON" cartridge. If the controller 80 determines that the currently-attached cartridges do not include an "ON" cartridge (e.g., NO in step S51), the controller 80 determines that a replacement error has not occurred. The controller 80 thus ends the replacement error detection process.

If the controller 80 determines that the currently-attached cartridges include at least one "ON" cartridge (e.g., YES in step S51), the routine proceeds to step S52.

In step S52, the controller 80 determines, with respect to each of the at least one "ON" cartridge, whether the remaining life of a corresponding previously-attached cartridge attached before the cartridge replacement was performed is less than the particular threshold. If, in step S51, the controller 80 determines that the currently-attached cartridges include two or more "ON" cartridges, in step S52, the controller 80 executes the determination as many as the number of "ON" cartridges. That is, the controller 80 determines, with respect to each of the at least one "ON" cartridge, whether the remaining life of a corresponding previously-attached cartridge has reached a particular life level that requires its replacement. Hereinafter, a previously-attached cartridge whose remaining life has reached the particular life level that requires its replacement may be referred to as an "expired" cartridge, and a previously-attached cartridge whose remaining life has not reached the particular life level may be referred to as an "unexpired" cartridge.

Figure 10:
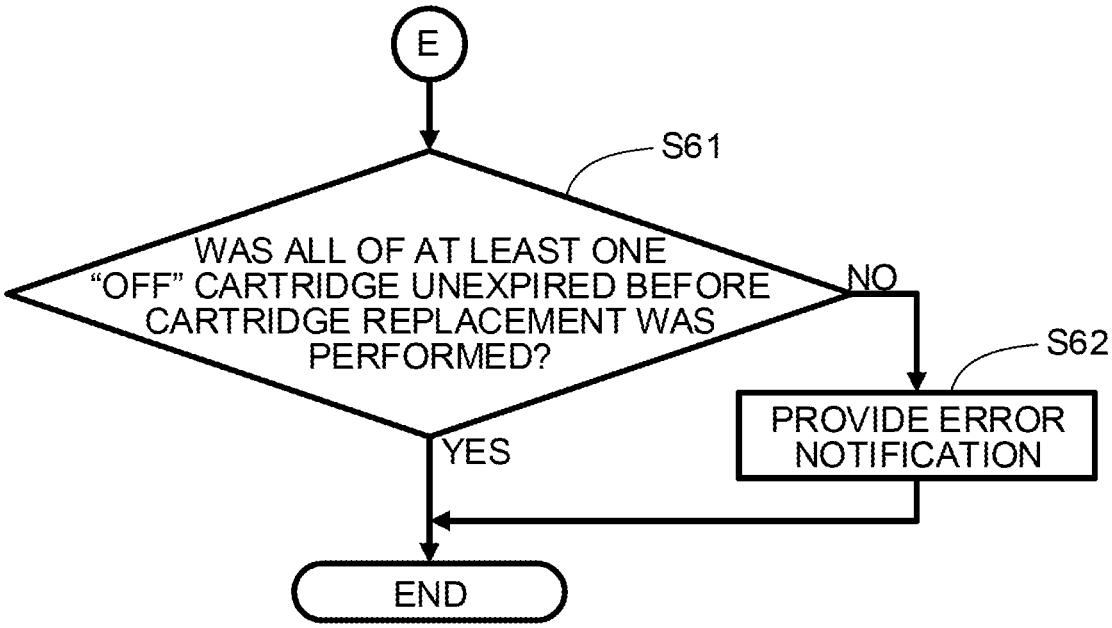
FIG. 10 is a continuation of the flowchart of FIG. 9 in the third illustrative embodiment according to one or more aspects of the disclosure.
Figure 11:
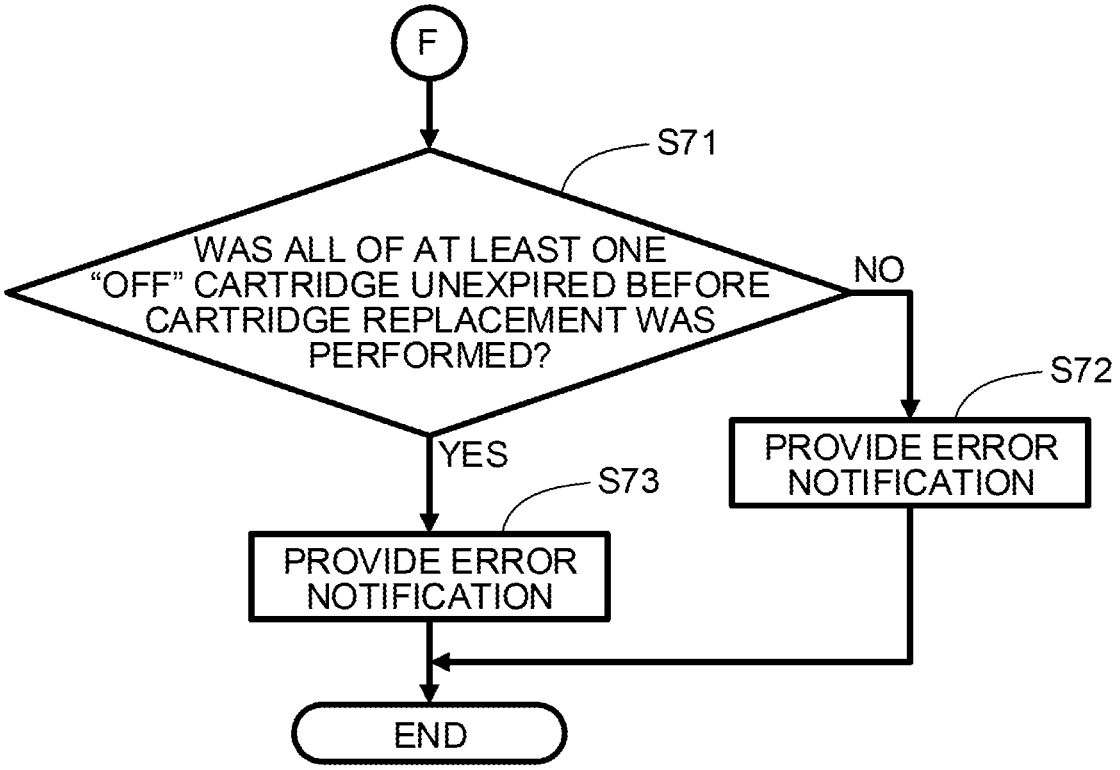
FIG. 11 is a continuation of the flowchart of FIG. 9 in the third illustrative embodiment according to one or more aspects of the disclosure.

If the controller 80 determines that the at least one previously-attached cartridge corresponding to the at least one "ON" cartridge does not include an expired cartridge (e.g., NO in step S52), the routine proceeds to step S61 (refer to FIG. 10). If the controller 80 determines that the at least one previously-attached cartridge corresponding to the at least one "ON" cartridge includes an expired cartridge (e.g., YES in step S52), the routine proceeds to step S53 (refer to FIG. 9).

In step S61, the controller 80 determines whether all of the at least one "OFF" cartridge (i.e., at least one non-replaced cartridge) was unexpired before the cartridge replacement was performed. If the controller 80 determines that all of the at least one "OFF" cartridge was unexpired before the cartridge replacement was performed (e.g., YES in step S61), the controller 80 ends the replacement error detection process. If the controller 80 determines that the at least one "OFF" cartridge includes at least one cartridge that expired before the cartridge replacement was performed (e.g., NO in step S61), the controller 80 causes the display 90 to display a message to provide error notification (e.g., step S62). The message may be an inquiry about whether the user intends to use all of the currently-attached cartridges.

In step S53, the controller 80 determines whether all of the at least one previously-attached cartridge corresponding to the at least one "ON" cartridge expired before the cartridge replacement was performed. If the controller 80 determines that all of the at least one previously-attached cartridge corresponding to the at least one "ON" cartridge expired before the cartridge replacement was performed (e.g., YES in step S53), the routine proceeds to step S54 (refer to FIG. 9). If the controller 80 determines that the at least one previously-attached cartridge corresponding to the at least one "ON" cartridge includes an unexpired cartridge (e.g., NO in step S53), the controller 80 determines that the at least one previously-attached cartridge includes an expired cartridge and an unexpired cartridge. In such a case, the routine proceeds to step S71 of FIG. 11.

In step S71, the controller 80 determines whether all of the at least one "OFF" cartridge (i.e., the at least one non-replaced cartridge) was unexpired before the cartridge replacement was performed. If the controller 80 determines that the at least one "OFF" cartridge includes at least one cartridge that expired before the cartridge replacement was performed (e.g., NO in step S71), the controller 80 causes the display 90 to display a message to provide error notification (e.g., step S72). The message may be an inquiry about whether the user intends to use all of the currently-attached cartridges.

Figure 13:
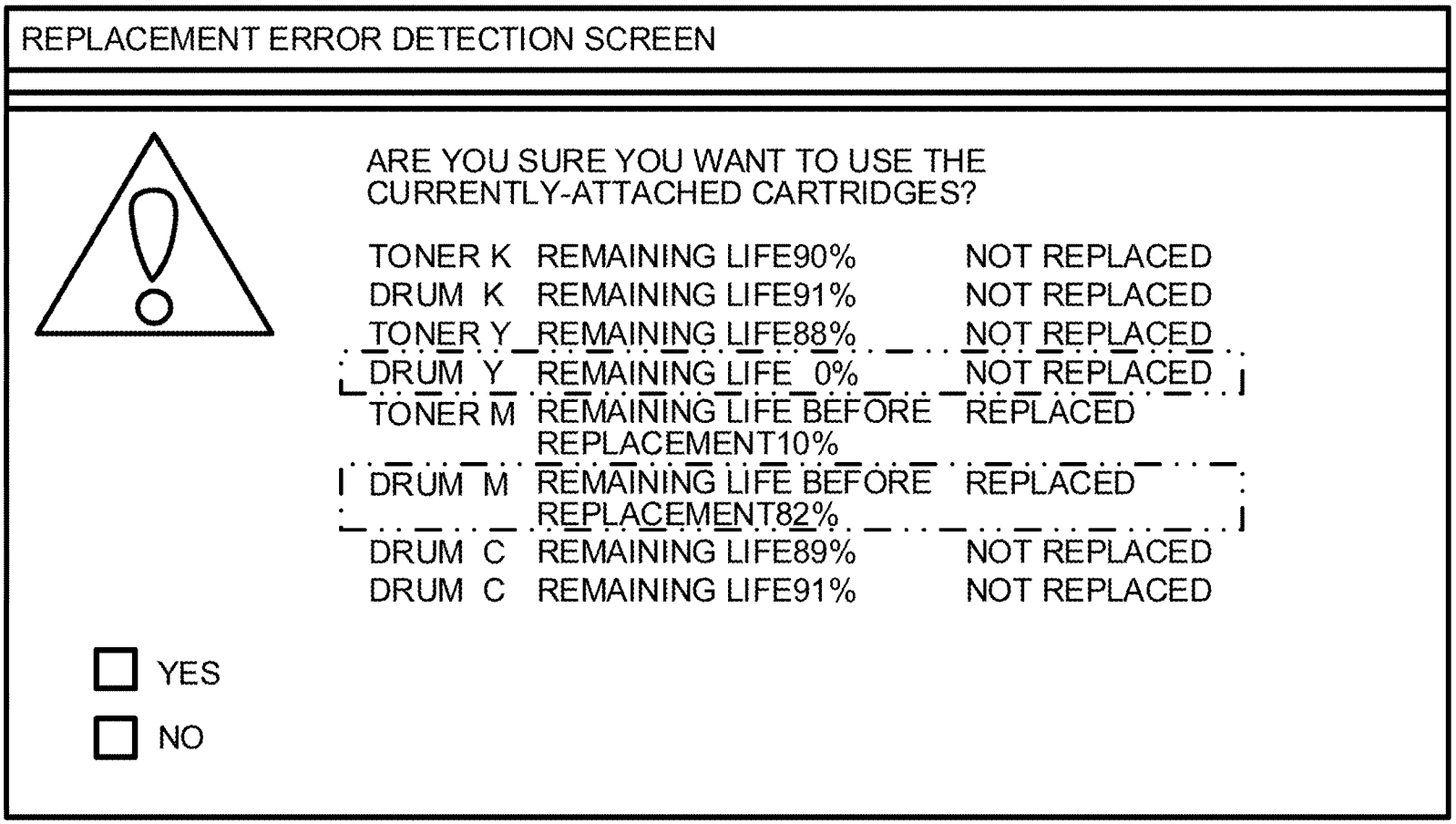
FIG. 13 illustrates an example of a message to be displayed on the display in the third illustrative embodiment according to one or more aspects of the disclosure.

FIG. 13 illustrates an example of a message to be displayed on the display 90 in step S72. The message may list, with respect to each of the cartridges, for example, a cartridge remaining life before the cartridge replacement was performed and indication as to whether the cartridge replacement was performed. More specifically, for example, for a newly-attached cartridge, the list shows the cartridge remaining life of a corresponding previously-attached cartridge attached before the cartridge replacement. For a non-replaced cartridge, the list shows the cartridge remaining life of the non-replaced cartridge before cartridge replacement was performed. For example, as illustrated in FIG. 13, one or more cartridges that may have been replaced mistakenly or that might not have been replaced mistakenly may be emphasized.

Figure 14:
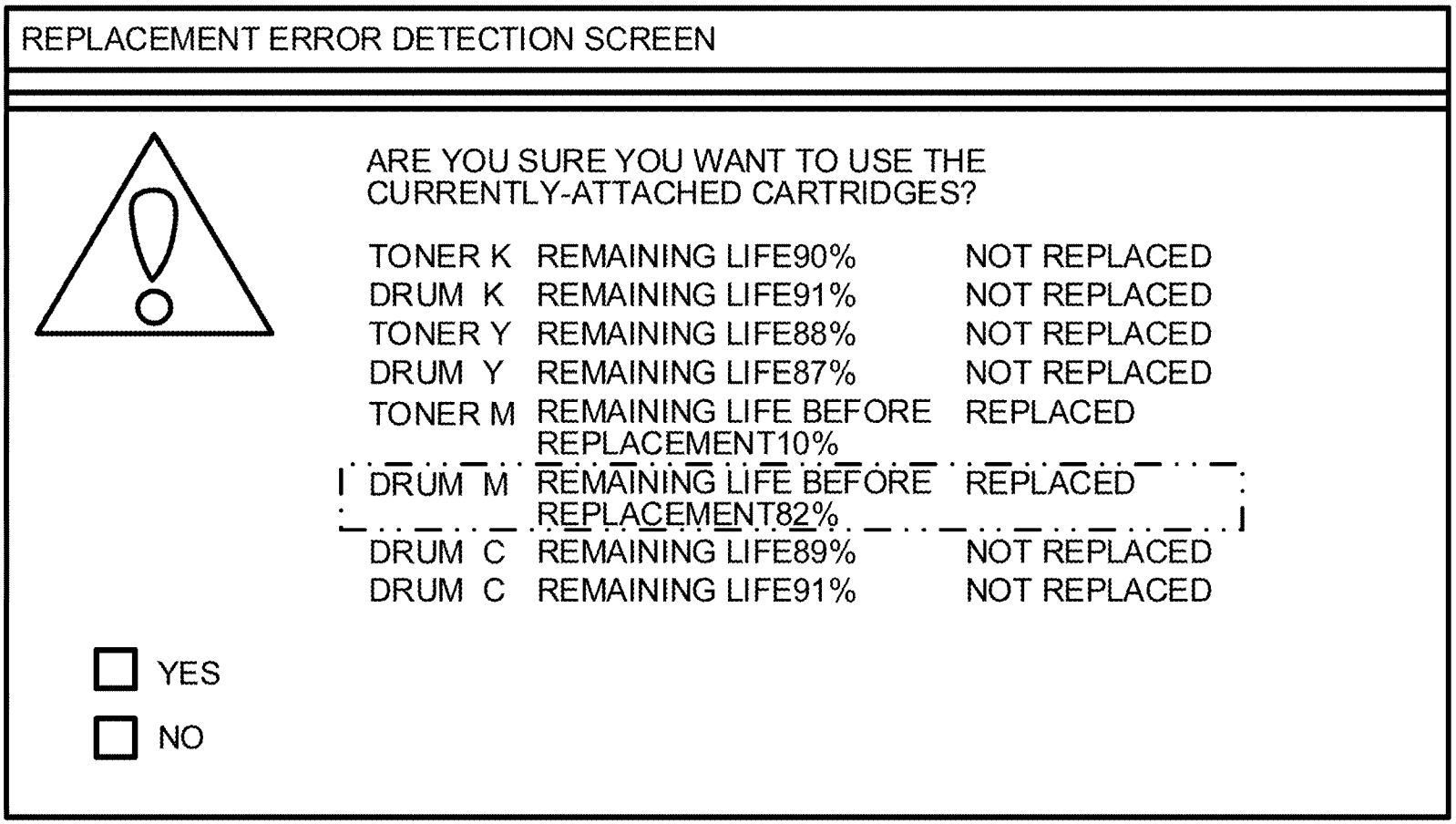
FIG. 14 illustrates an example of another message to be displayed on the display in the third illustrative embodiment according to one or more aspects of the disclosure.

If the controller 80 determines that all of the at least one "OFF" cartridge (i.e., the at least one non-replaced cartridge) was unexpired before the cartridge replacement was performed (e.g., YES in step S71), the controller 80 causes the display 90 to display a message to provide error notification (e.g., step S73). The message may be again an inquiry about whether the user intends to use the currently-attached cartridges. FIG. 14 illustrates an example of another message to be displayed on the display 90 in step S73.

As illustrated in FIG. 9, in step S54, the controller 80 determines whether all of the at least one "OFF" cartridge (i.e., the at least one non-replaced cartridge) was unexpired before the cartridge replacement was performed. If the controller 80 determines that all of the at least one "OFF" cartridge was unexpired before the cartridge replacement was performed (e.g., YES in step S54), the controller 80 determines that a replacement error has not occurred.

If the controller 80 determines that the at least one "OFF" cartridge includes at least one cartridge that expired before the cartridge replacement was performed (e.g., YES in step S54), the routine proceeds to step S81 (refer to FIG. 12).

In step S81, the controller 80 determines whether the remaining life of each of the at least one previously-attached cartridge corresponding to the at least one "ON" cartridge is shorter than the remaining life of each of the at least one "OFF" cartridge. If the controller 80 determines that the remaining life of each of the at least one previously-attached cartridge corresponding to the at least one "ON" cartridge is shorter than the remaining life of each of the at least one "OFF" cartridge (e.g., YES in step S81), the controller 80 ends the replacement error detection process.

If the controller 80 determines that the at least one "ON" cartridge includes at least one cartridge whose remaining life is longer than the remaining life of each of the at least one "OFF" cartridge (e.g., NO in step S81), the controller 80 causes the display 90 to display a message to provide error notification (e.g., step S82). The message may be an inquiry about whether the user intends to use all of the currently-attached cartridges.

According to the third illustrative embodiment, as described above, the controller 80 determines the appropriateness of the cartridge replacement with respect to each of the cartridges (e.g., the newly-attached cartridges and the non-replaced cartridges) based on whether each of the cartridges attached before the cartridge replacement was performed is expired or unexpired. Such determination may enable the controller 80 to detect the cartridge replacement error.

4. Alternative Embodiments

While the disclosure has been described in detail with reference to the specific embodiments thereof, these are merely examples, and various changes, arrangements and modifications may be applied therein without departing from the spirit and scope of the disclosure. Hereinafter, alternative embodiments will be described mainly different points from the illustrative embodiments.

In the first illustrative embodiment, in the update process, the drum-cartridge life information is stored in both the main-body memory 82 and the drum-cartridge memory 22, and the toner-cartridge life information is stored in both the main-body memory 82 and the toner-cartridge memory 32. Nevertheless, in other embodiments, for example, the drum-cartridge life information might not necessarily be stored in the drum-cartridge memory 22 and the toner-cartridge life information might not necessarily be stored in the toner-cartridge memory 32.

In other embodiments, for example, in the first replacement time determination process or in the second replacement time determination process, the controller 80 may determine, based on various kinds of cartridge life information, whether a cartridge has reached its replacement time.

In the illustrative embodiments, each of the toner cartridges 30 includes the developing roller 31. Nevertheless, in other embodiments, for example, each of the drum cartridges 20 instead of the toner cartridges 30 may include a developing roller. In such a case, the total number of rotations of a developing roller may be stored as the drum-cartridge life information.

In the first and second illustrative embodiments, the image forming apparatus 1 includes four process cartridges each including a pair of the drum cartridge 20 and the toner cartridge 30. Nevertheless, the number of process cartridges to be attached to the frame 11 might not be limited to the specific example. In other embodiments, for example, the number of process cartridges may be at least one, or may be less than or more than four.

In the third illustrative embodiment, a single process cartridge includes a pair of the drum cartridge 20 and the toner cartridge 30. Nevertheless, in other embodiment, for example, a single process cartridge may include a single drum cartridge and a plurality of toner cartridges. In such a case, the drum cartridge may be configured to receive the plurality of toner cartridges. The drum cartridge may include a plurality of photosensitive drums in accordance with the number of toner cartridges to be attached to the drum cartridge.

The particular elements and features disclosed in the illustrative embodiments and the alternative embodiments may be combined with each other in other ways without departing from the spirit and scope of the disclosure.

What is claimed is:

1. An image forming apparatus comprising:
a user interface;
a controller; and
a main memory accessible by the controller,
wherein the controller is configured to execute:
determining whether drum-cartridge identification information read from the main memory matches drum-cartridge identification information stored in a drum-cartridge memory of a drum cartridge,
determining whether toner-cartridge identification information read from the main memory matches toner-cartridge identification information stored in a toner-cartridge memory of a toner cartridge,
determining whether replacement of the drum cartridge is necessary,
determining whether replacement of the toner cartridge is necessary,
providing a first error notification to the user interface, in a case where the drum cartridge identification information read from the main memory does not match the drum-cartridge identification information stored in the drum-cartridge memory and replacement of the drum cartridge is not necessary, and
providing a second error notification to the user interface, in a case where the toner cartridge identification information read from the main memory does not match the toner-cartridge identification information stored in the toner-cartridge memory and replacement of the toner cartridge is not necessary.

2. The image forming apparatus according to claim 1,
wherein the controller is configured to provide the second error notification to the user interface after providing the first error notification to the user interface.

3. The image forming apparatus according to claim 1,
wherein the controller is configured to provide the second error notification to the user interface prior to providing the first error notification to the user interface.

4. The image forming apparatus according to claim 1,
wherein the controller is configured to:
update drum-cartridge life information stored in the main memory and toner-cartridge life information stored in the main memory,
determine whether replacement of the drum cartridge is necessary using the updated drum-cartridge life information, and
determine whether replacement of the toner cartridge is necessary using the updated toner-cartridge life information.

5. The image forming apparatus according to claim 1, further comprising a frame configured to receive the drum cartridge and the toner cartridge.

6. The image forming apparatus according to claim 5, further comprising the drum cartridge and the toner cartridge, the drum cartridge and the toner cartridge being attached to the frame.

7. The image forming apparatus according to claim 6,
wherein the toner cartridge is attached to the frame in a state where the toner cartridge is attached to the drum cartridge.

8. The image forming apparatus according to claim 5,
wherein controller is further configured to:
read drum-cartridge identification information from a drum-cartridge memory of a replacement drum cartridge in a state where the replacement drum cartridge is received by the frame, and
read toner-cartridge identification information from a toner-cartridge memory of a replacement toner cartridge in a state where the replacement toner cartridge is received by the frame,
write the drum-cartridge identification information from the drum-cartridge memory of the replacement drum cartridge into the main memory, and
write the toner-cartridge identification information from the toner-cartridge memory of the replacement toner cartridge into the main memory.

9. The image forming apparatus according to claim 1,
wherein controller is further configured to execute:
reading the drum-cartridge identification information from the drum-cartridge memory of the drum cartridge, and
reading the toner-cartridge identification information from the toner-cartridge memory of the toner cartridge.

10. The image forming apparatus according to claim 4,
wherein the main memory stores a first threshold and a second threshold, the first threshold relates to a life of the drum cartridge, the second threshold relates to a life of the toner cartridge,
wherein in determining whether replacement of the drum cartridge is necessary, the controller compares the drum-cartridge life information read from the main memory with the first threshold, and
wherein in determining whether replacement of the toner cartridge is necessary, the controller compares the toner-cartridge life information read from the main memory with the second threshold.

11. The image forming apparatus according to claim 4,
wherein the drum-cartridge memory stores the drum-cartridge life information,
wherein the toner-cartridge memory stores the toner-cartridge life information,
wherein in determining whether replacement of the drum cartridge is necessary, the controller compares the drum-cartridge life information read from the main memory with the drum-cartridge life information stored in the drum-cartridge memory, and
wherein in determining whether replacement of the toner cartridge is necessary, the controller compares the toner-cartridge life information read from the main memory with the toner-cartridge life information stored in the toner-cartridge memory.

12. The image forming apparatus according to claim 1,
wherein the controller is configured to write drum-cartridge identification information of a replacement drum cartridge into main memory from the drum-cartridge memory of the replacement drum cartridge in a case where the controller determines that replacement of the drum cartridge is necessary, and wherein the controller is configured to write the toner-cartridge identification information of a replacement toner cartridge into main memory from the toner-cartridge memory of the replacement toner cartridge in a case where the controller determines that replacement of the toner cartridge is necessary.

13. The image forming apparatus according to claim 12, wherein the controller is configured to write drum-cartridge identification information of a replacement drum cartridge into main memory from the drum-cartridge memory of the replacement drum cartridge only in a case where the controller determines that replacement of the drum cartridge is necessary, and wherein the controller is configured to write the toner-cartridge identification information of a replacement toner cartridge into main memory from the toner-cartridge memory of the replacement toner cartridge only in a case where the controller determines that replacement of the toner cartridge is necessary.

14. The image forming apparatus according to claim 9, wherein the controller is configured to determine whether replacement of the drum cartridge is necessary in a case where the controller determines the drum-cartridge identification information stored in the main memory does not match the drum-cartridge identification information from the drum cartridge memory of the drum cartridge.

15. The image forming apparatus according to claim 14, wherein the controller does not determine whether replacement of the drum cartridge is necessary in a case where the controller determines the drum-cartridge identification information stored in the main memory matches the drum-cartridge identification information from the drum cartridge memory of the drum cartridge.

16. The image forming apparatus according to claim 9, wherein the controller is configured to determine whether replacement of the toner cartridge is necessary in a case where the controller determines the toner-cartridge identification information stored in the main memory does not match the toner-cartridge identification information from the toner cartridge memory of the toner cartridge.

17. The image forming apparatus according to claim 16, wherein the controller does not determine whether replacement of the toner cartridge is necessary in a case where the controller determines the toner-cartridge identification information stored in the main memory matches the toner-cartridge identification information from the toner cartridge memory of the toner cartridge.

18. The image forming apparatus according to claim 4, wherein the drum-cartridge life information includes at least one of a total number of rotations of the photosensitive drum or a total number of sheets that have been printed using the photosensitive drum.

19. The image forming apparatus according to claim 4, wherein the toner-cartridge life information includes at least one of a total number of rotations of the developing roller, a total number of sheets that have been printed using the developing roller, or a total number of output dots.

20. The image forming apparatus according to claim 1, wherein:

the user interface comprises a display, the first error notification includes a first message displayed on the display, and the second error notification includes a second message displayed on the display.

21. The image forming apparatus according to claim 20, wherein the first message and the second message prompt a user to select either a first option or a second option, the first option indicating that the user intends to use a newly-attached drum cartridge and a newly-attached toner cartridge, the second option indicating that the user intends to detach at least one of the newly-attached drum cartridge and the newly-attached toner cartridge from the frame and attach back at least one of a previously-attached drum cartridge and a previously-attached toner cartridge to the frame.

22. The image forming apparatus according to claim 1, wherein the controller is configured to determine whether replacement of the drum cartridge or the toner cartridge is necessary after the controller executes both:

determining whether the drum-cartridge identification information read from the main memory matches drum-cartridge identification information stored in a drum-cartridge memory of the drum cartridge, and determining whether the toner-cartridge identification information read from the main memory matches toner-cartridge identification information stored in a toner-cartridge memory of the toner cartridge.

23. The image forming apparatus according to claim 1, wherein the main memory comprises a main-body memory positioned within a frame of the image forming apparatus.

24. An image forming apparatus comprising:

a frame;

a drum cartridge being detachably attachable to the frame, the drum cartridge including:

a photosensitive drum; and a drum-cartridge memory;

a toner cartridge being detachably attachable to the frame, the toner cartridge including a toner-cartridge memory;

a user interface;

a controller; and a main memory accessible by the controller, wherein the controller is configured to execute:

determining whether drum-cartridge identification information read from the main memory matches drum-cartridge identification information stored in the drum-cartridge memory, determining whether toner-cartridge identification information read from the main memory matches toner-cartridge identification information stored in the toner-cartridge memory, determining whether replacement of the drum cartridge is necessary, determining whether replacement of the toner cartridge is necessary, providing a first error notification to the user interface, in a case where the drum cartridge identification information read from the main memory does not match the drum-cartridge identification information stored in the drum-cartridge memory and replacement of the drum cartridge is not necessary, and providing a second error notification to the user interface, in a case where the toner cartridge identification information read from the main memory does not match the toner-cartridge identification information stored in the toner-cartridge memory and replacement of the toner cartridge is not necessary.

25. The image forming apparatus according to claim 24, wherein the toner cartridge includes a developing roller, and wherein the developing roller contacts the photosensitive drum in a state where the toner cartridge is attached to the drum cartridge.

26. The image forming apparatus according to claim 24, wherein the drum cartridge includes a developing roller.

27. An image forming apparatus comprising:

a frame configured to detachably receive a drum cartridge and a toner cartridge;

a user interface;

a controller; and a main memory accessible by the controller, wherein the controller is configured to execute:

determining whether replacement of the drum cartridge is necessary;

determining whether replacement of the toner cartridge is necessary; and in a case that replacement of one of the toner cartridge or the drum cartridge is not necessary and it is detected that the drum cartridge and the toner cartridge are replaced based on comparison between data stored in the main memory and data obtained from a drum-cartridge memory of the drum cartridge and a toner-cartridge memory of the toner cartridge, providing a notification to the user interface indicating that replacement of only one of the drum cartridge or the toner cartridge is required.

28. The image forming apparatus according to claim 27, wherein the controller is further configured to perform:

determining whether drum-cartridge identification information read from the main memory matches drum-cartridge identification information stored in the drum-cartridge memory of the drum cartridge; and determining whether toner-cartridge identification information read from the main memory matches toner-cartridge identification information stored in the toner-cartridge memory of the toner cartridge, wherein the notification is provided to the user interface in further response to the controller determining that (1) the drum-cartridge identification information read from the main memory does not match the drum-cartridge identification information stored in a drum-cartridge memory, and (2) the toner-cartridge identification information read from the main memory does not match the toner-cartridge identification information stored in a toner-cartridge memory.

29. An image forming apparatus comprising:

a frame configured to detachably receive a drum cartridge and a toner cartridge;

a user interface;

a controller; and a main memory accessible by the controller, wherein the controller is configured to execute:

determining whether replacement of the drum cartridge is necessary, determining whether replacement of the toner cartridge is necessary, providing a first error notification to the user interface, in a case where the drum cartridge has been replaced and replacement of the drum cartridge is not necessary based on comparison between data stored in the main memory and data obtained from a drum-cartridge memory of the drum cartridge, and providing a second error notification to the user interface, in a case where the toner cartridge has been replaced and replacement of the toner cartridge is not necessary based on comparison between data stored in the main memory and data obtained from a toner-cartridge memory of the toner cartridge.

30. The image forming apparatus according to claim 29, wherein the controller determines that the drum cartridge has been replaced by determining whether drum-cartridge identification information read from the main memory matches drum-cartridge identification information stored in the drum-cartridge memory of the drum cartridge.

31. The image forming apparatus according to claim 29, wherein the controller determines that the toner cartridge has been replaced by determining whether toner-cartridge identification information read from the main memory matches toner-cartridge identification information stored in the toner-cartridge memory of the toner cartridge.

* * * * *